US005845593A

United States Patent [19]

Birkestrand

[11] Patent Number: 5,845,593

[45] Date of Patent: Dec. 8, 1998

[54] MAN AND WIND POWERED AQUATIC VEHICLE

[76] Inventor: Orville J. Birkestrand, 1435 Jersey Ridge Rd., Davenport, Iowa 52803

[21] Appl. No.: 659,445

[22] Filed: Jun. 6, 1996

Related U.S. Application Data

[60] Provisional application No. 60/000,003 Jun. 8, 1995.

[51] Int. Cl. [6] ..... B63B 35/00

[52] U.S. Cl. ..... 114/39.001; 114/91; 440/95; 440/98; 440/30

[58] Field of Search ..... 416/7, 84, 85; 440/95–98, 21, 26–31; 29/508–511, 516, 517; 114/352–354, 39.1, 90, 91, 93, 301, 305

[56] References Cited

U.S. PATENT DOCUMENTS

| | | | |
|---|---|---|---|
| 328,559 | 10/1885 | Baker | 440/95 |
| 485,369 | 11/1892 | Breyer . | |
| 583,762 | 6/1897 | Moore . | |
| 633,903 | 9/1899 | Pond | 440/98 |
| 868,183 | 10/1907 | Heggen . | |
| 872,140 | 11/1907 | Mikulasek . | |
| 876,133 | 1/1908 | Beebe . | |
| 883,018 | 3/1908 | Henry . | |
| 1,000,076 | 8/1911 | Cracroft . | |
| 1,836,793 | 12/1931 | Dorrance . | |
| 1,913,605 | 6/1933 | Martin | 440/95 |
| 1,928,511 | 9/1933 | Martin | 440/96 |
| 2,112,673 | 3/1938 | Lewis | 29/508 |
| 2,121,558 | 6/1938 | Coe et al. | 29/516 |
| 2,364,327 | 12/1944 | Swennes | 440/96 |
| 2,685,270 | 8/1954 | Pieraccioni Dit | 115/22 |
| 3,249,084 | 5/1966 | Plants | 115/25 |
| 3,724,011 | 4/1973 | Scholle | 9/2 |
| 3,903,817 | 9/1975 | Marcil | 114/143 |
| 3,987,749 | 10/1976 | Anderson | 115/25 |
| 4,230,060 | 10/1980 | McCoy | 114/39 |
| 4,269,134 | 5/1981 | Shapland | 114/107 |
| 4,379,701 | 4/1983 | David | 440/21 |
| 4,437,424 | 3/1984 | Lord | 114/91 |
| 4,459,932 | 7/1984 | Hildebrand | 114/270 |
| 4,496,325 | 1/1985 | Tweg | 440/26 |
| 4,772,237 | 9/1988 | Zalkauskas | 440/96 |
| 5,072,682 | 12/1991 | Urroz et al. | 114/91 |
| 5,074,811 | 12/1991 | Crisman | 440/6 |
| 5,131,341 | 7/1992 | Newman | 114/39.1 |
| 5,237,263 | 8/1993 | Gannon | 323/288 |
| 5,255,624 | 10/1993 | Legare | 114/90 |
| 5,316,101 | 5/1994 | Gannon | 180/221 |

FOREIGN PATENT DOCUMENTS

| | | | |
|---|---|---|---|
| 30680 | 2/1982 | Japan | 114/91 |
| 7290 | 12/1897 | United Kingdom | 440/95 |
| 17406 | 7/1898 | United Kingdom | 440/95 |

*Primary Examiner*—Ed Swinehart
*Attorney, Agent, or Firm*—Cesari and McKenna, LLP

[57] ABSTRACT

A non sinkable, easily re-rightable aquatic vehicle has a lightweight body with a front, a rear, a bottom and opposite sides and contains a seat for supporting a pilot. A pair of front sheaves are rotatably mounted to opposite sides of the body near the front of the body and a pair of rear sheaves are rotatably mounted to opposite sides of the body near the rear thereof. A first flotation track is engaged around and extends between the front and rear sheaves on one side of the body and a second flotation track is engaged around and extends between the front and rear sheaves on the other side of the body. Each said flotation track includes an endless band engaged around a front and rear sheave and a multiplicity of buoyant flotation treads connected to the band at spaced apart locations therealong to form upper and lower series of flotation treads extending between the associated front and rear sheaves. A pedal drive is mounted to the body for producing an output torque which is coupled to at least one of the sheaves on each side of said body so as to advance the tracks in order to propel the vehicle and brakes are provided to steer and stop the vehicle. A mast and sail may also be mounted to the body in such a way that the mast can be tilted in any direction and rotated about its axis to operate the vehicle under sail with maximum ease and efficiency.

73 Claims, 11 Drawing Sheets

MAN AND WIND POWERED AQUATIC VEHICLE

This application stems from provisional application Ser. No. 60/000,003, filed Jun. 8, 1995.

FIELD OF THE INVENTION

This invention relates to a man-powered aquatic vehicle which can also be operated under sail. It relates especially to a vehicle of this type which rides on recirculating flotation tracks which are circulated by a pedal drive powered by the vehicle operator.

BACKGROUND OF THE INVENTION

Pedal driven aquatic vehicles have been available for many years. They range from pontoon or catamaran-type boats fitted with paddle wheels rotated by pedal power to floating tricycles having oversize flotation wheels provided with ribs which engage the water and propel the vehicle forward when the wheels are rotated. An example of such an aquatic tricycle is described in U.S. Pat. No. 3,249,084.

There also exist, at least in concept, aquatic vehicles which employ pedal driven recirculating treads as the means for propulsion. For example, U.S. Pat. No. 883,018 describes a water bicycle having front and rear water-tight flotation drums or wheels with the rear drums being rotated by a pedal crank. A pair of endless buoyant propeller bands encircle the front and rear drums at the opposite sides of the bicycle, there being blades projecting from the outer surfaces of the bands. When the pedals are pushed, the movement of the flotation bands causes the blades to press against the water and propel the vehicle forward or backward depending upon the direction of rotation of the pedal crank. That patented water bicycle is steered by a rudder which is turned by turning a front handlebar in the manner of an ordinary street bicycle.

The prior aquatic vehicles described above are disadvantaged in many respects. All of them have fixed flotation pontoons of one kind or another which must be pulled through the water when the vehicle is under way. These fixed flotation devices impart a drag to the vehicle so that a significant amount of energy is required in order to propel the vehicle. Therefore, it is difficult for an individual to pedal the vehicle at even a moderate speed, e.g., 6–8 mph, for a prolonged period of time. Also, some of the aquatic vehicles of this type, when occupied, have a center of gravity, even without the operator and more so with the operator, which is above or close to the vehicle's center of buoyancy and this buoyancy is invariably is positioned, almost exclusively, totally, underneath the pilot. Resultantly, these machines are often more stable in the upside down or capsized position, making them difficult, if not impossible, for a lone pilot to re-right, even if he/she gets out of the vehicle to do so. In fact, the pilots of most such vehicles need outside assistance in order to re-right the vehicle, so that the prior machines are dangerous and unsuitable for use in all but the most calm and protected waters. Actually, we know of no vehicles of this general type which can be re-righted quickly and easily with the pilot remaining in his/her seat, In sum, then, the conventional aquatic vehicles are unstable and not particularly sea-worthy.

It is a fact also that none of the prior man-powered aquatic vehicles are built for speed and maneuverability. Aside from the energy losses due to the fixed flotation devices described above, the prior vehicles are invariably steered by means of a rudder mechanism which adds more drag to the vehicle and which requires appreciable vehicle motion in order to be of any use at all. Moreover, even when the vehicle is under full power, such vehicles with rudders have a relatively large turning radius so that they are difficult to maneuver in tight quarters.

Additionally, none of the man-powered aquatic vehicles of which we are aware have a wind power option. In other words, they include no provision for operating the vehicle under sail such that the pilot who is pedaling the vehicle can also control the position of the sail to achieve optimum speed through the water.

Finally, conventional man-powered watercraft tend to be relatively heavy structures which are complex and costly to make and to assemble. Consequently, they are difficult to repair particularly when the vehicle is underway. This makes it impractical to conduct competitions involving such man-powered aquatic vehicles.

SUMMARY OF THE INVENTION

Accordingly, the present invention aims to provide an improved man-powered aquatic vehicle.

A further object of the invention is to provide an aquatic vehicle which can be boarded while on land, propelled into the water and to a destination and leave the water under power so that the operator can reemerge from the vehicle on land safe and dry.

Another object of the invention is to provide a man-powered vehicle which is aerodynamic and capable of being propelled through the water at relatively high speed.

Still another object of the invention is to provide a vehicle of this type which is highly maneuverable even at low speeds.

A further object of the invention is to provide a man-powered aquatic vehicle whose motion through the water can be sustained with a minimum amount of energy being expended by the pilot of the vehicle.

A further object of the invention is to provide such an aquatic vehicle which can also be operated under wind power.

Yet another object of the invention is to provide an aquatic vehicle which is very strong and rugged, yet which is light-weight and portable.

A further object of this invention is to provide an inherently safe, unsinkable aquatic vehicle, re-rightable by the pilot while he/she remains seated in the vehicle's cockpit.

Still another object of the invention is to provide such a vehicle which is constructed so that its various critical parts can be replaced relatively easily even when the vehicle is in the water.

Other objects will, in part, be obvious and will, in part, appear hereinafter. The invention accordingly comprises the features of construction, combination of elements and arrangement of parts which will be exemplified in the following detailed description, and the scope of the invention will be indicated in the claims.

Briefly, my aquatic vehicle comprises a body or housing composed of a very strong ultra-light tubular frame with a fabric skin that protectively encloses an operator or pilot so that the pilot can sit comfortably in the body just above the waterline with his feet on the pedals of a pedal crank. The pedal crank drives a pair of flotation tracks at the opposite sides of the vehicle body. Each flotation track comprises front and rear spoked sheaves with plural rims around which are stretched a plurality of cables to which are connected a web-type bridle assembly which releasably captures a series of inflatable flotation treads. The rear sheaves are connected to the pilot's pedal crank through a bicycle-type chain drive and a derailleur and differential gear system.

Mounted to the vehicle frame near the pilot are speed controls to actuate the vehicle's front and rear speed change derailleurs and also brake controls to actuate disc breaks associated with the rear sheaves. Actuating the right brake control slows down the vehicle's right flotation track while proportionally speeding up the left flotation track through the differential action of the vehicle's differential system thus causing the vehicle to turn to the right. Likewise, actuating the left brake control turns the vehicle to the left. Actuating both brake controls brings both flotation tracks to a stop.

As will be seen, the entire aquatic vehicle rests on the flotation treads along the lower stretches of the flotation tracks. No other part of the machine touches the water or the ground. Thus, the flotation tracks can provide propulsion on land and, on water, 1) buoyancy, 2) steering and 3) propulsion.

As will be seen later, the individual flotation treads are specially shaped to 1) bite into the water at low speed with minimal slippage 2) plane over the surface of the water at high speeds, and 3) enter and leave the water with minimum effort or energy expense. Except for slight slippage during acceleration, these flotation treads, while engaging the water, are not moving appreciably relative to the water. Hence, they produce no waves and thus the vehicle has minimal frictional and form drag, unlike other aquatic vehicles with fins, rudders, propeller blades, hull bottoms, etc., which must be dragged or pushed through the water. Also, since the pilot and the internal components of the machine are sheathed in an aerodynamically shaped body or housing, aerodynamic drag is minimized. The net result of all of the above features is a vehicle with radically minimized water and air drag which incorporates a multi-speed manual drive that allows the pilot to optimize his energy output and vehicle speed.

To extend the vehicle's speed and range and to add to the pilot's pleasure, my aquatic vehicle is also equipped with a sail. This produces an aerodynamically-shaped sail-powered machine with minimal water resistance in which the pilot supplies the minimal but important energy required to move the flotation treads in and out of the water to overcome 1) bearing, 2) water and 3) wind losses. Since there is no appreciable water resistance to the vehicle's advancement, there is no need for a tall sail with its attendant large heeling forces in order to enable the vehicle to move at high speed. Also, a shorter sail and mast reduce the requirement for sail rigging, keel structure and ballast associated with tall masts and sails.

Also, as will be described in more detail later, the mast of my aquatic vehicle incorporates a swivel support and cables leading back to the pilot to enable the pilot to tilt as well as to rotate the mast while the vehicle is underway. This arrangement allows the pilot to pivot the mast and sail toward the wind. On a beam reach, for example, if the mast and sail are leaned backward and toward the wind, then the wind forces, which are perpendicular to the sail surface, will produce a strong upward force, as well as a forward force, tending to lift the vehicle up and out of the water so that the vehicle can travel faster over the water.

As will be described in more detail later, the mast can also be swung aft to a stowed position when the boat is moored or at anchor, and it is also buoyant so that it helps to re-right the vehicle should it be inverted in the water.

Thus, the present machine does away with the buoyancy pontoons like the ones on the prior aquatic vehicles described at the outset. Instead, it incorporates a multiplicity of small flotation treads or floats which are strung onto cable assemblies which are, in turn, mounted on lightweight twin-rim spoked sheaves which function as cogs driven by pedal power. My vehicle also avoids the water skin friction and form drag attending conventional boat steering mechanisms such as rudders by driving the two flotation tracks through a differential mechanism.

My vehicle combines the relatively weak human power required to drive the flotation tracks with sail power as the main driving force for the vehicle so as to create an all-weather, sail-powered machine with essentially no water resistance to forward motion that has unlimited range at speeds normally obtained only by high powered boats.

My vehicle, when normally operated, should not be thought of as merely the sum of two power inputs, namely pedal and sail. Rather, the machine is more aptly likened to an electronic power transistor with a human operator, through foot power, supplying the low level but necessary, "signal" power input, which enables the passage of the considerably larger wind power input to act efficiently upon the vehicle to propel the vehicle at high speed. All that the pilot has to do is to supply the incremental power to drive the flotation track 0 to 3 knots or so, regardless of whether the vehicle speed is 10 or 40 knots due to windpower. What we have then is a vehicle with essentially no water resistance to forward motion as long as the pilot supplies the "signal" incremental velocity input. At higher speeds, water inertial effects become more dominant and this pilot supplied incremental speed input can tend toward zero. The upper speed of the vehicle will be limited by the balance between the forward forces generated by the sail and the counterbalancing aerodynamic drag forces of the body and sail; there should be essentially no water resistance or drag.

As we shall see, the vehicle incorporates several novel structural features which enable the above objectives to be met, some of which features have utility not only in aquatic vehicles of the type described herein, but also in other vehicle structures where strength and minimum weight are of prime concern.

BRIEF DESCRIPTION OF THE DRAWINGS

For a fuller understanding of the nature and objects of the invention, reference should be had to the following detailed description taken in connection with the accompanying drawings, in which.

DESCRIPTION OF THE PREFERRED EMBODIMENT

Figure 1C:
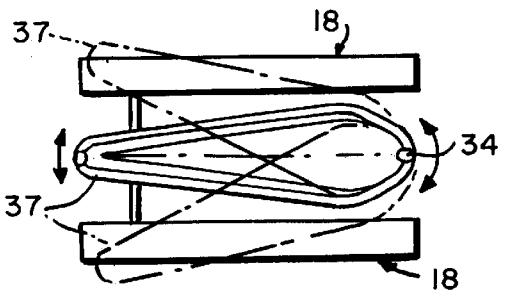
FIGS. 1B and 1C are diagrammatic views illustrating the locus of motion of the mast on the FIG. 1A vehicle.
Figure 1B:
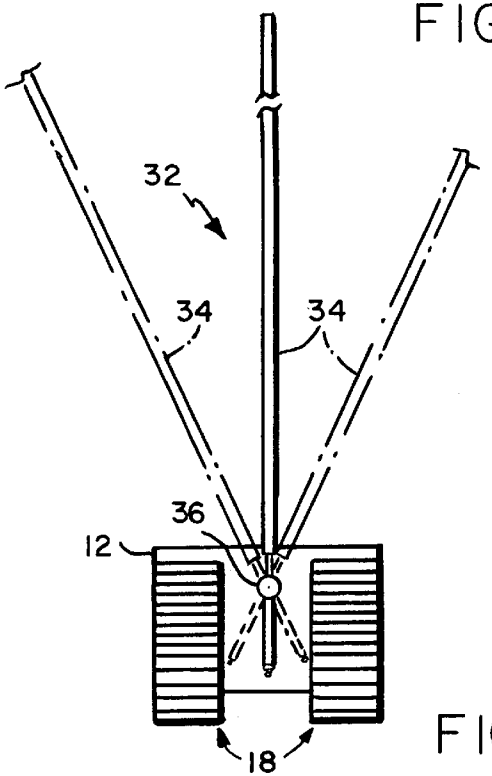
Figure 1A:
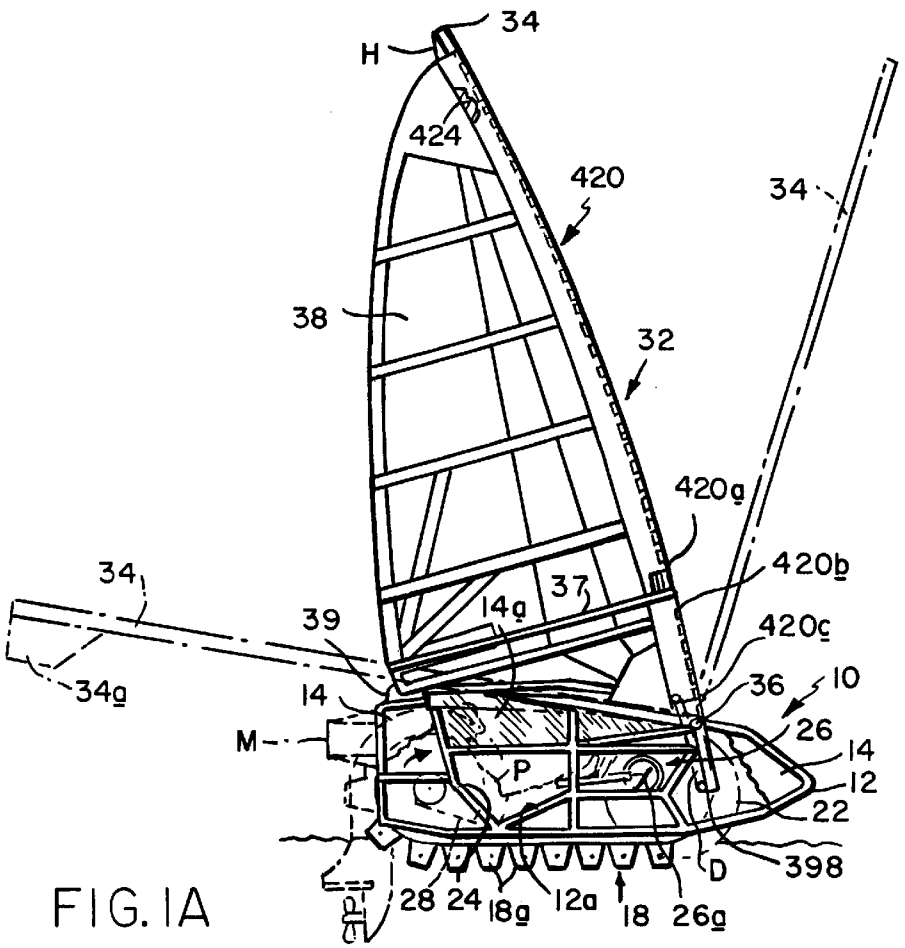
FIG. 1A is a side elevational view with parts broken away showing a man and wind-powered aquatic vehicle incorporating my invention.

Referring to FIGS. 1A to 1C of the drawings, my man and wind-powered aquatic vehicle comprises a hollow main body or enclosure shown generally at 10 composed of a very strong light-weight tubular frame 12 which defines a seat 12*a* for supporting a pilot P in a recumbent position within frame 12. Frame 12 may be covered all or part way around by a skin 14 of sheet material e.g., polyester, to protectively enclose pilot P and to give the vehicle good aerodynamic characteristics. Portions of the skin 14 at the top of the vehicle may be made of a transparent material such as monofiber, as shown at 14*a*, so that the pilot P has a clear view. Obviously, if skin 14 extends all around frame 12, appropriate openings (not shown) may be provided in skin 14 at the top and/or rear of body 10 to enable the pilot P to get in and out of the vehicle. These openings may be closed as needed by appropriate hook and loop fasteners, zippers or the like (not shown).

Also, as a safety precaution, the tubular frame 12 itself may be fully or partially foam filled so that even if the vehicle is denuded to its frame, it will not sink even with the pilot on board. In addition, flotation panels 16 (FIG. 3) may be provided in the bottom and side walls of body 10 which will prevent the vehicle from sinking in the event of an emergency situation. It should be understood, however, that these panels 16 are supported by frame 12 above water level when the vehicle is at rest so that they do not normally help to float the vehicle and its occupant. The panels 16 at the sides of the vehicle also isolate the pilot P from the moving parts of the vehicle to be described, and help to insulate the pilot when the vehicle is operating in colder weather.

The vehicle frame 12 is supported in the water (and on land) by a pair of recirculating flotation tracks 18 positioned on opposite sides of frame 12. Each track 18 carries a series of flotation treads 18*a* and is engaged around front sheaves 22 and rear sheaves 24 rotatably mounted to the opposite sides of frame 12. In order to advance the tracks 18, the pilot P, using his/her feet, turns the pedal crank 26*a* of a pedal crank assembly located at the vehicle's longitudinal centerline and shown generally at 26. The motion of the pedal crank 26*a* is transmitted by a drive chain 28 to the rear sheaves 24 causing the sheaves to rotate in the direction of the arrow.

As will be seen later, the vehicle incorporates derailleur and differential mechanisms so that pilot P, by pedaling the pedal crank assembly 26*a*, can cause either or both flotation tracks 18 to turn at various selected speeds. Normally, when the vehicle is at rest in the water, the lower stretches of the two flotation tracks 18 extend below frame 12 and the treads 18*a* thereof are buoyant enough to support frame 12 so that it is just above water level as shown in FIG. 1A. Furthermore, as will be seen, the treads 18*a* are designed so that when the pilot circulates the flotation tracks 18 by turning the pedal crank 26*a*, the treads 18*a* will bite or press into the water causing the vehicle to turn left or right or to advance depending upon whether one or both tracks is operative at the time.

While my aquatic vehicle can be propelled using pedal power alone, it preferably also incorporates wind power means, shown generally at 32 and to be described in more detail later, for enabling the vehicle to be operated under wind power. Suffice it to say at this point that the means 32 may comprise a two piece telescoping mast 34 whose lower end is mounted by a swivel assembly 36 to frame 12. Extending laterally from mast 34 is a wishbone-type boom 37 and the mast and boom together may support a sail 38. When the vehicle is underway, the pilot P sitting in seat 12*a* can raise the sail 38 by means of a halyard H and tilt mast 34 and thus sail 38 between a rear or aft position shown in solid lines in FIG. 1A to a forward position illustrated in dotted lines in that figure. This changes the "center of effort" position of sail 38 so that the pilot can use this feature to help steer the vehicle. The pilot can also tilt mast 34 up to about 25° to either side of the vehicle centerline to the extreme positions shown in dotted lines in FIG. 1B. This allows the pilot to lean sail 38 into the wind to generate upward lift which tends to cause the vehicle to plane so that the vehicle can travel faster over the water. Further, as shown in FIG. 1C, the swivel 36 assembly also allows the mast 34 to pivot about its axis so that the boom 37 and sail 38 can be let out laterally in the usual way to either side of body 10 by a sheet 39 (FIG. 1A) so that sail 38 has the desired trim.

When the wind power means 32 is not needed, the sail 38 may be lowered (or reefed) using a downhaul line D and the mast 34 tilted aft or rearwardly so that it reposes in the position shown in phantom in FIG. 1A. If desired, a small panel 34*a* may be removably mounted to the top or free end of mast 34 to function as a weathervane-sail to keep the vehicle headed into the wind when the vehicle is riding out a storm or is moored or at anchor.

If desired, a standard outboard motor may be removably mounted to the stern of frame 12 as shown in phantom at M in FIG. 1A. Thus, the present aquatic vehicle offers seven propulsion options as follows: pedal only, sail only, motor only, pedal and sail, pedal and motor, sail and motor, pedal, sail and motor.

The Vehicle Frame 12

Figure 2:
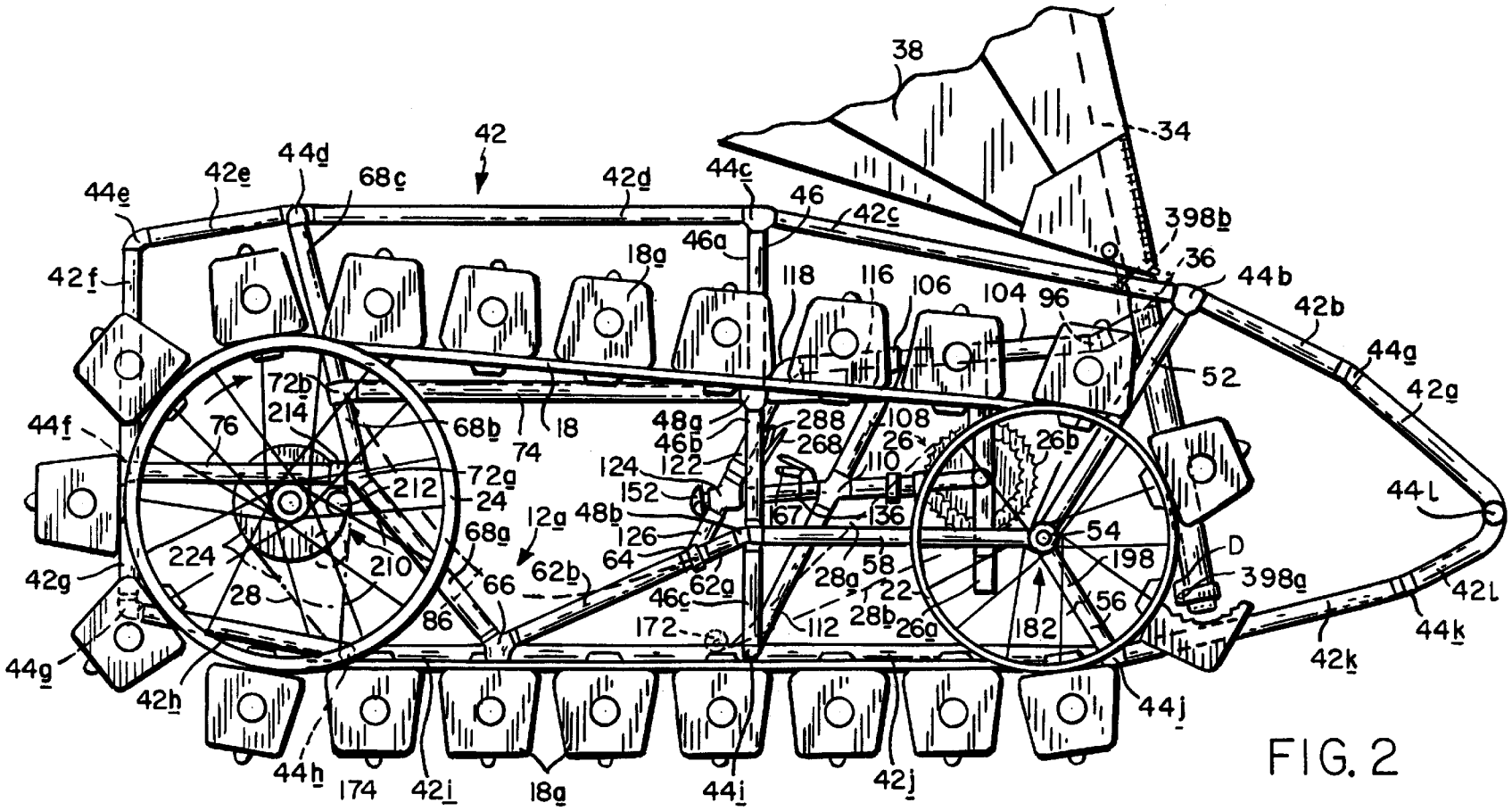
FIG. 2 is a side elevational view with parts broken away on a larger scale showing the various components of the FIG. 1A vehicle in greater detail.
Figure 3:
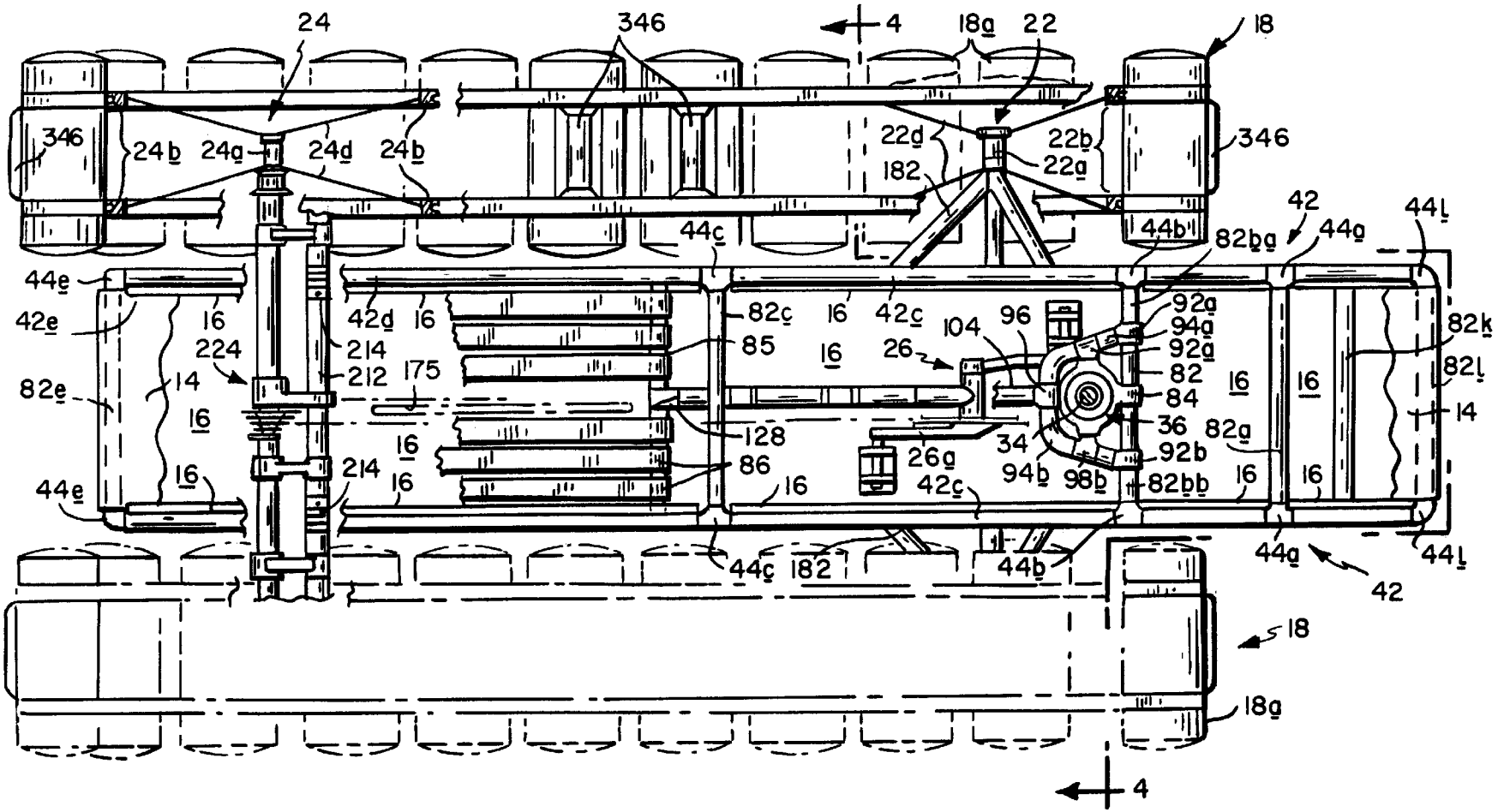
FIG. 3 is a plan view with parts broken away of the vehicle.
Figure 4:
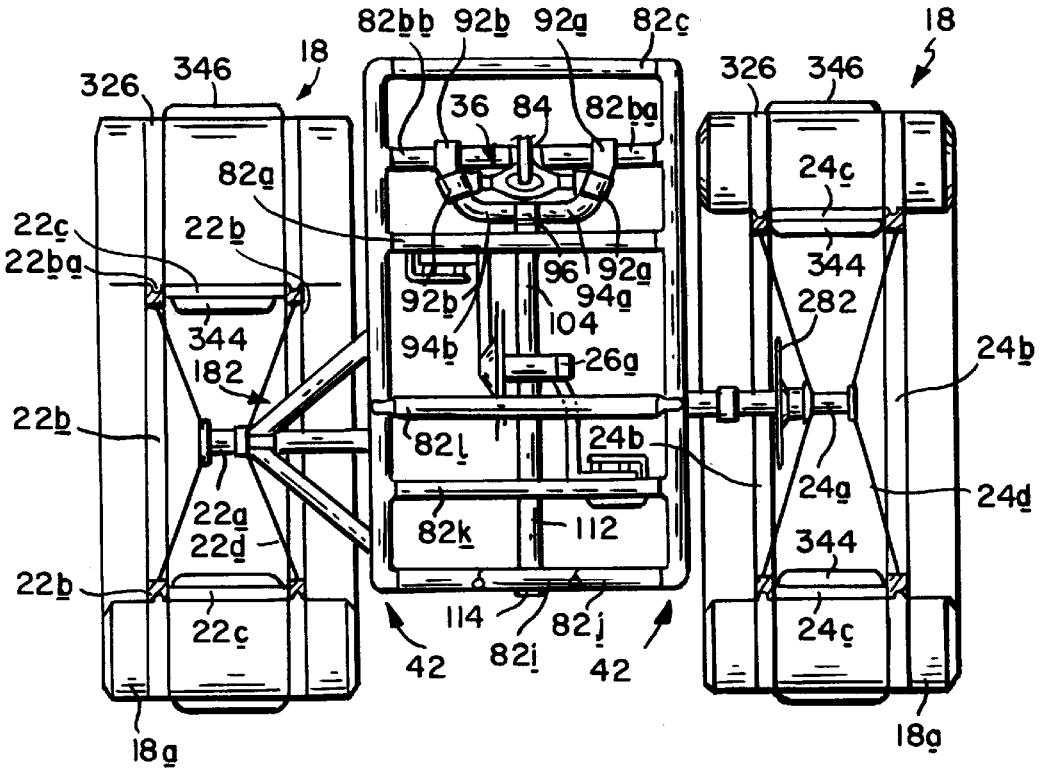
FIG. 4 is a sectional view taken along line 4—4 of FIG. 3.

Referring now to FIGS. 2 to 4 of the drawings, frame 12 is composed of two mirror-image, generally aerodynamically-shaped side sections 42. Each such section is formed by a multiplicity of tubular frame members connected by special multiple node couplings or joints to be described later in connection with FIGS. 5A and 5B. The components of the frame may be of aluminum, magnesium, plastic or other strong lightweight material. Proceeding from stem to stern counterclockwise around the side section 42 illustrated in FIG. 2, there are variously shaped tubular members 42*a* , 42*b* . . . 42*l* connected end to end by three or four-node couplings 44*a*, 44*b* . . . 44*l*, respectively.

To rigidify each frame side section 42, a vertical post 46 extends between couplings 44*c* and 44*i*, said post being formed by three tubular members 46*a*, 46*b* and 46*c* connected end to end by four node couplings 48*a* and 48*b*. Also, as best seen in FIGS. 2, 7A and 7B, a tubular frame member 52 extends between the four-node coupling 44*b* and a three node sleeve coupling 54 also connected by tubular member 56 to the four-node coupling 44*j*.

Figure 7A:
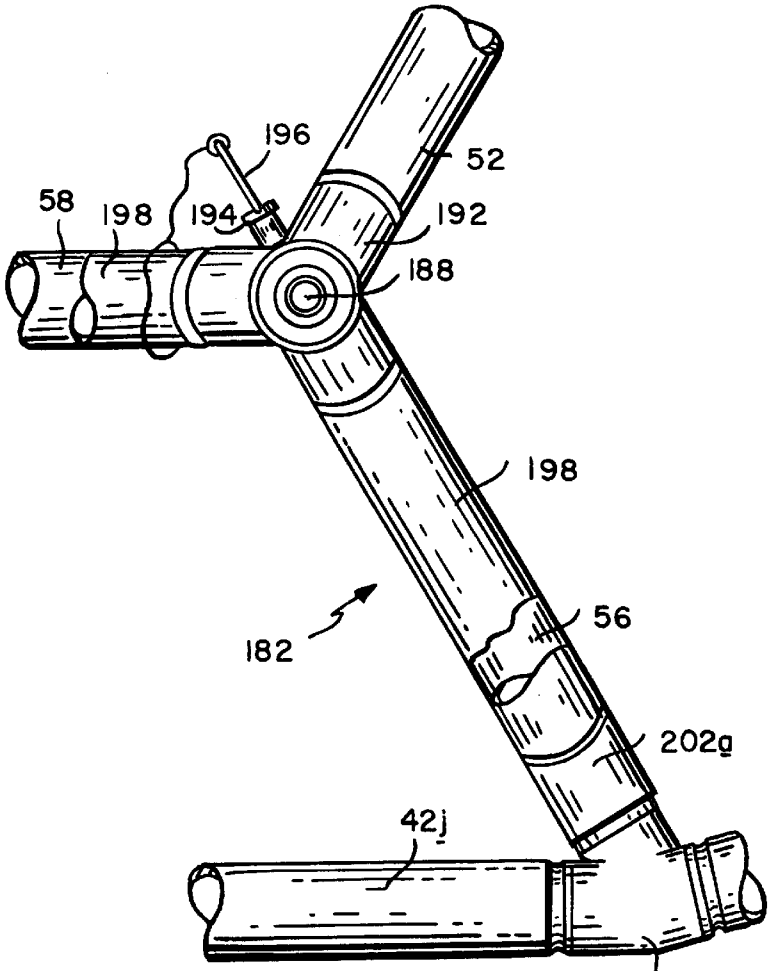
FIGS. 7A and 7B are side and front views, respectively, with parts broken away, showing the front axle construction of the vehicle.
Figure 7B:
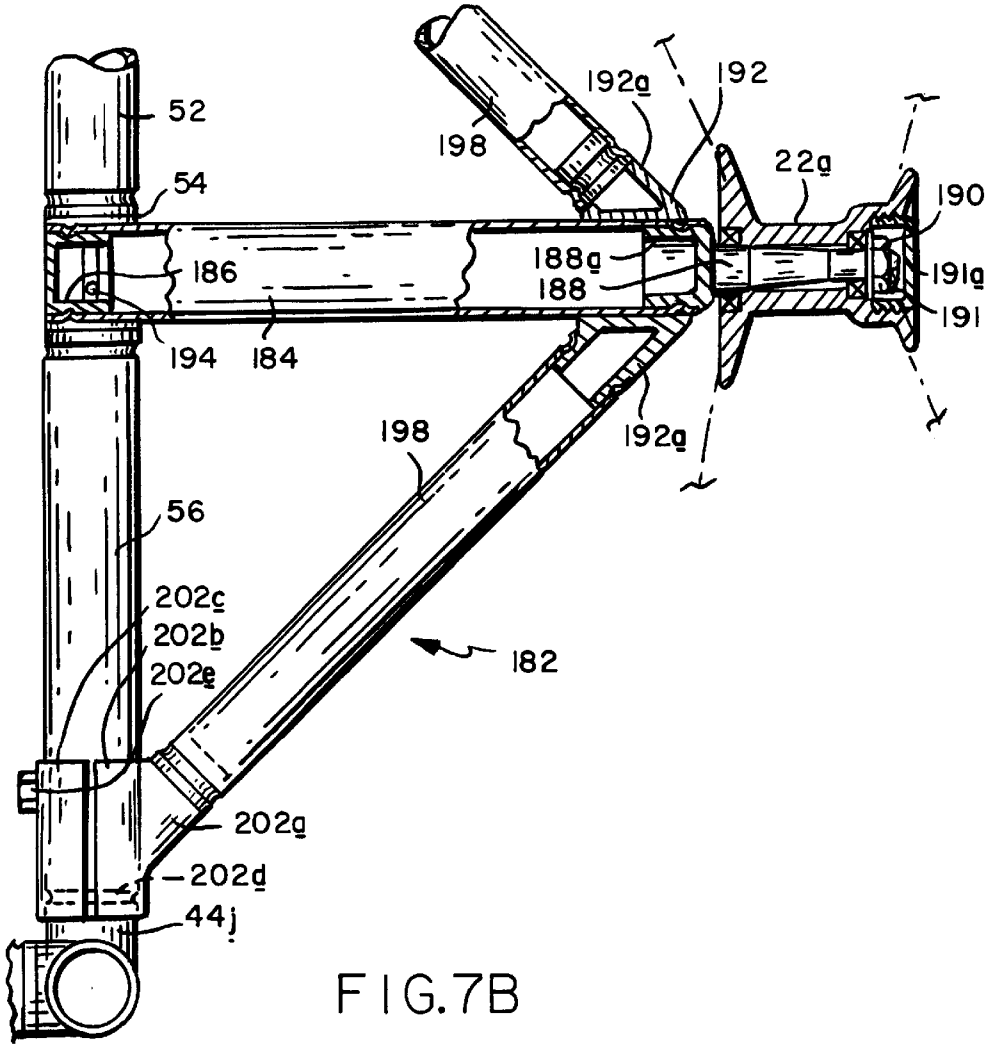

Still referring to FIGS. 2 and 7A, a horizontal frame member 58 extends rearwardly from coupling 54 to the four-node coupling 48*b*. Also connected to coupling 48*b* is a short downwardly rearwardly extending tubular member 62*a* coupled by a three-node coupling 64 to a tubular member 62*b* leading down to a bracket 66 engaged around the tubular member 42*i* at the bottom of side section 42. Extending upwardly rearwardly from a second node of bracket 66 is a tubular member 68*a* whose other end is connected by a three-node coupling 72*a* to a tubular member 68*b* whose opposite end is coupled by a three-node coupling 72*b* to a tubular member 68*c* leading to coupling 44*d* at the top of side section 42. To provide extra rigidity, there is also a horizontal tubular member 74 connecting couplings 48*a* and 72*b*. As will be seen, the tubular members 62*b* and 68*a*–68*c* form the side rails of seat 12*a* in FIG. 1A. To reinforce the back of the seat, a horizontal frame member 76 extends rearwardly from coupling 72*a* to the four-node coupling 44*f* at the rear of the frame side section 42.

Referring to FIGS. 2 to 4, to maintain the two side sections 42 in spaced apart relation, a series of transverse tubular frame members are provided all around the frame 12. Proceeding counterclockwise around the frame from the front of the vehicle, there is a frame member 82*a* connecting couplings 44*a* and two in-line frame members 82*ba* and 82*bb* coupled together end to end by a coupling 84 and connected between couplings 44*b*. Additional transverse frame members 82*c* to 82*l* are provided between the corresponding couplings 44*d* to 44*l*, respectively, not all of which members are specifically shown in the drawing figures. When constructed thusly, frame 12 constitutes a very rigid, yet very lightweight structure for supporting the pilot P and the remaining parts of the aquatic vehicle. As noted above, frame 12 is covered by skin 14, 14*a* to minimize aerodynamic drag and to shield the pilot from the elements.

As best seen in FIGS. 2 and 3, to define the front of seat 12*a*, a transverse frame member 85 is connected between the couplings 64 at the forward ends of the two frame members 62*b*. A series of flexible straps 86 are connected between frame member 85 and the transverse frame member 82*d* that connects the brackets 44*d* at the top of the frame 12 to form a sling-type seat 12*a*. This arrangement provides the pilot P with a very comfortable seating platform while he is protectively enclosed within the frame 12 and skin 14.

The Frame 12 "Joinery"

Figure 5A:
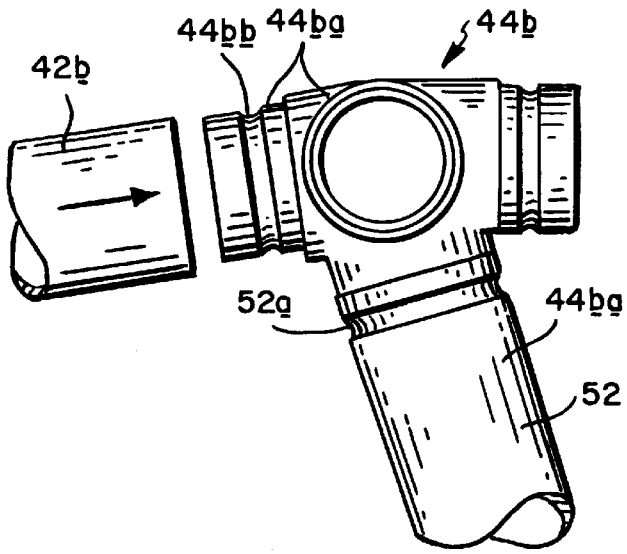
FIGS. 5A and 5B are fragmentary side and front elevational views, respectively, with parts broken away on a still larger scale showing typical frame joints present in the FIG. 1A vehicle.
Figure 5B:
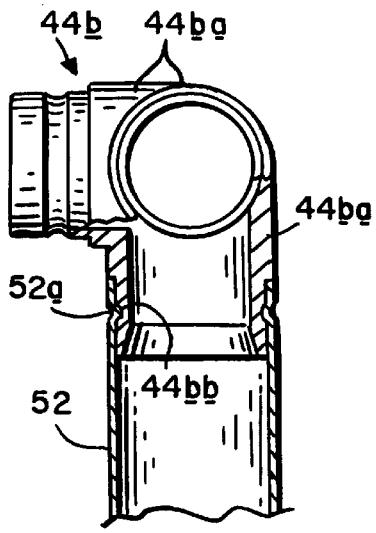

We have briefly described the various two, three and four-node couplings that connect the various tubular frame members together to form frame 12. A typical four-node coupling, say coupling 44*b*, is illustrated in FIGS. 5A and 5B. The other couplings are more or less the same except for the number and/or direction of their nodes or branches. Coupling 44*b* has four generally cylindrical nodes or branches 44*ba* each of which is formed with a circumferential groove 44*bb* more or less midway along its length. The coupling may be solid or hollow and it may be made of any suitable strong rugged metal or plastic material. The illustrated coupling 44*b* happens to be hollow and made of aluminum metal.

All of the coupling nodes or branches 44*ba* are sized so that they can be received snugly within the ends of the tubular frame members, e.g., members 42*b*, 52, etc. With this method, relatively inexpensive, loose-tolerance extruded tubing may be used, cut to length and resized at the ends to precise dimensions using a simple tube expander. After a particular node 44*ba* is seated within the associated frame member, the tubular member may be rolled to form a circular bead 52*a* in the tube opposite the underlying groove 44*bb* of the coupling node. The rolled bead joint connections lock each coupling to the associated tubular members so that the coupling rigidly connects together all of the tubular members engaged to that coupling.

This technique for connecting together the frame members comprising frame 12 has several distinct advantages. It allows frame 12 to be assembled very quickly since no fasteners are involved; only a simple roll beading step is required to make the joint. This may be done by a simple hand tool similar to a pipe cutter which engages around the tubes and, with a blunt edge wheel, presses the tube walls into the coupling grooves 44*bb*. Once assembled, the various connections will not tend to loosen over time due to vibration and shock forces imposed on frame 12. My roll bead joinery also allows the use of tubular frame members having ultra-thin walls which tubing would be impossible to use if the various joints had to be made by conventional welding, brazing or gluing methods. In addition, since no heat is involved, the individual parts can be prefinished and/or pre-heat treated before assembly of the vehicle without regard to other types of parts in the vehicle. Furthermore, those traditional methods, commonly used in bicycle manufacture, would be too slow and costly and would require assembly personnel with high skills thereby increasing the overall cost of making the vehicle.

My roll bead joinery also allows the connection of thick and thin wall frame members which may be of totally different materials. For example, a thick-wall plastic tubular member may be connected through a node to a thin-wall tubular member of aluminum, titanium or stainless steel. Also, when a coupling is of plastic material, tubular members of different metals may be connected without fear of electrolytic action occurring between them. Also, unlike welding, brazing, gluing and other connection methods, with my rolled bead connections, one can at any distant time instantly visually inspect each joint for soundness long after the vehicle has been assembled. Additionally, this construction method allows for the easy introduction of larger or shorter vehicle models almost instantaneously without additional tooling costs simply by changing the cut-off lengths of selected tubular members comprising frame 12. Thus the roll bead connection technique disclosed here should have wide application not only in the manufacture of aquatic vehicles, but also in bicycle manufacture and other applications where it is necessary to connect together a multiplicity of tubular members to form a strong lightweight frame structure.

The Support For The Mast Swivel Assembly 36 And Pedal Crank Assembly 26

As best seen in FIGS. 2–4, 11A and 11B, a pair of brackets 92*a* and 92*b* are engaged midway along the two transverse frame members 82*ba* and 82*bb*, respectively, and fixed there by suitable means. Coupled to those brackets by roll beads are a pair of generally L-shaped frame members 94*a* and

94*b*. The short legs of those members are connected together by a three-node coupling 96 so that the frame members 82*ba*, 82*bb*, 94*a* and 94*b* form a downwardly-rearwardly extending ring. Mounted midway along the long legs of the frame members 94*a* and 94*b* are a pair of pivot brackets 98*a* and 98*b* which pivotally support the mast swivel assembly 36 to be described in more detail later in connection with FIGS. 11A and 11B.

Still referring to FIGS. 2–4, the coupling 96 connecting the two frame members 94*a* and 94*b* is also coupled to a rearwardly extending frame member 104 whose opposite end is connected to a branch of a three node coupling 106. A second branch of that coupling 106 is connected to a downwardly extending frame member 108 which leads to a sleeve coupling 110 and from there, by way of a frame member 112, to a bracket 114 mounted to the middle of the transverse frame member 82*i* at the bottom of frame 12 as best seen in FIG. 4.

The third node or branch of the coupling 106 is connected to a frame member 116 which leads to an angled two node coupling 118 located more or less midway between the two vertical tubular members 46*a* at the opposite sides of frame 12. The other node of coupling 118 is connected to a downwardly rearwardly extending tubular member 122 whose other end connects to a sleeve coupling 124. Coupling 124 is also connected by way of a short frame member 126 to a bracket 128 mounted midway along the transverse seat frame member 85; see FIG. 3.

The purpose of the aforesaid support structure is to support, at the frame 12 centerline, the two sleeve brackets 110 and 124 in aligned spaced-apart relation so that they can receive and support the pedal crank assembly 26.

The Pedal Crank Assembly 26

Figure 6A:
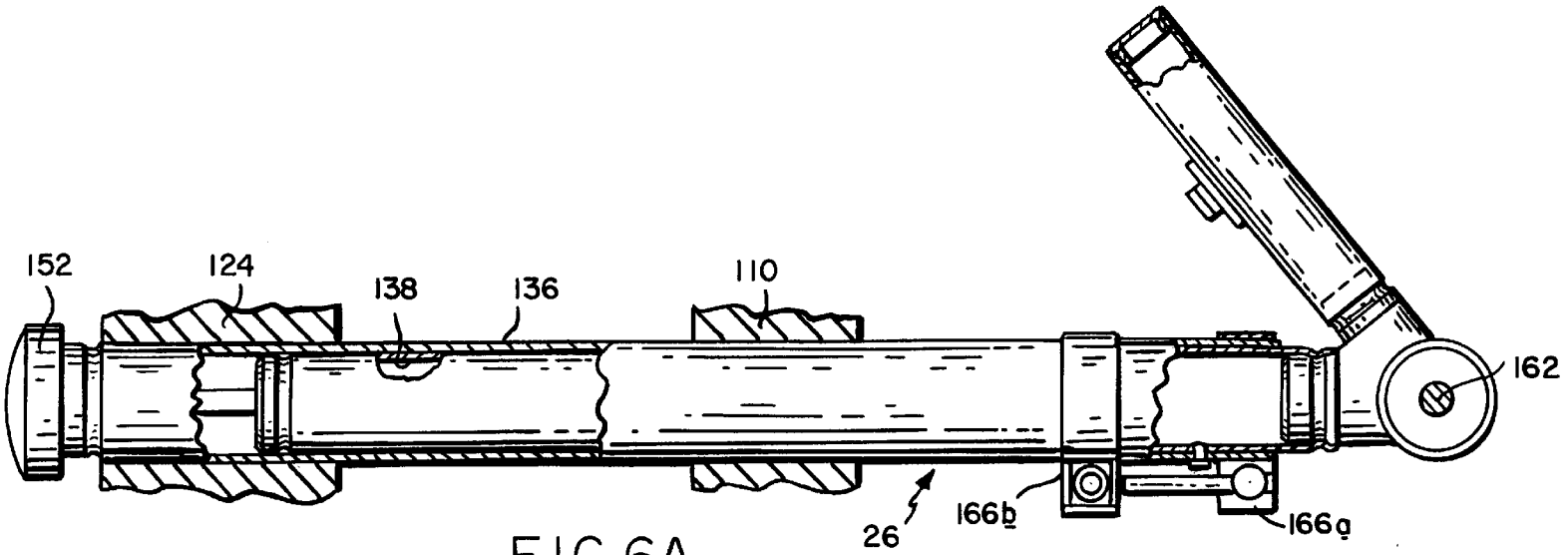
FIGS. 6A and 6B are side and top views, respectively, with parts broken away, on a larger scale, showing the pedal crank assembly of the vehicle in greater detail.
Figure 6B:
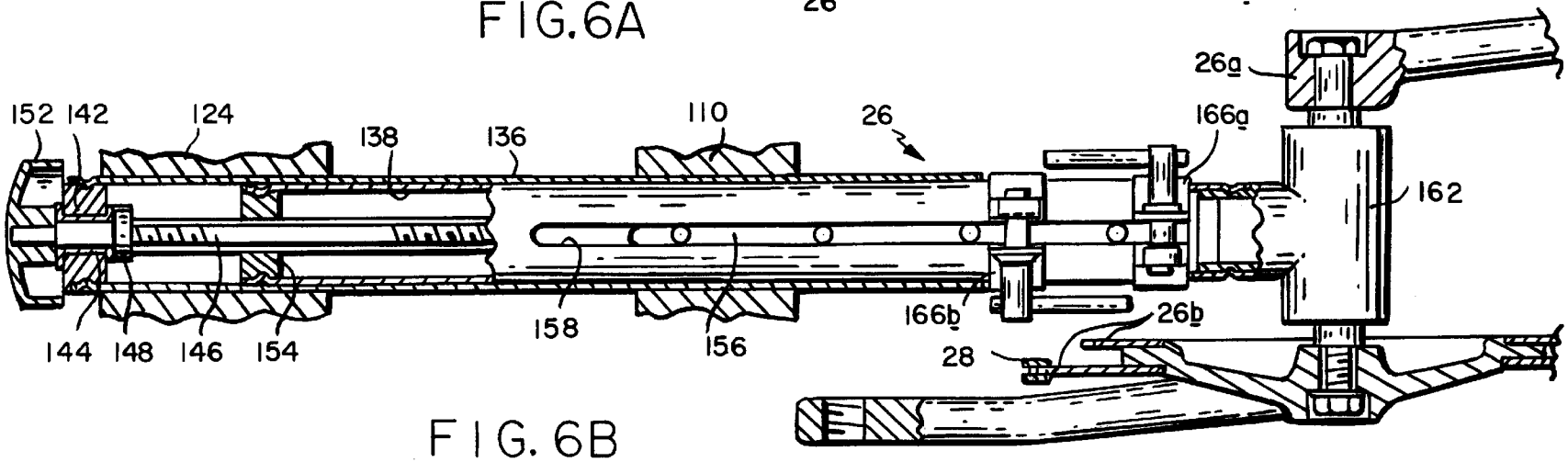

Referring now to FIGS. 6A and 6B, assembly 26 comprises outer and inner telescoping tubes 136 and 138. Tube 136 is received in the sleeve brackets 110 and 124 and held there by suitable means. One end of the outer tube 136 is closed by an annular plug 142 which is anchored in the tube by a roll bead of the type described above. The hole through plug 142 is lined by a sleeve bearing 144 which rotatably supports one end segment of a long screw 146 which extends along the common axis of the two tubes 136 and 138. The axial position of the screw is fixed relative to plug 142 by a collar 148 on the screw and an external knob 152 affixed to the end of the screw.

Screw 146 is screwed through a nut 154 mounted to the inner end of the inner tube 138 so that by turning the screw 146 in one direction or the other by means of knob 152, the inner tube 138 will be caused to extend or retract relative to outer tube 136. The two tubes are prevented from rotating relative to one another by means of a longitudinal key 156 mounted to the inner tube 138 which key slides along a keyway 158 formed in the wall of the outer tube 136.

Mounted to the opposite end of the inner tube 138 by means of a roll bead is a T-shaped bottom bracket 162 for housing the pedal crank 26*a* and associated ball bearings. This crank mechanism is similar to the ones found on conventional multiple speed bicycles. When the pedal crank support assembly 26 is mounted as shown in FIGS. 1 to 3, the pilot P, by turning knob 152 in one direction or the other, can move the pedal crank 26*a* toward and away from seat 12*a* to position the pedals of the pedal crank to best suit the pilot. Once the position of the pedal crank has been set, that position may be fixed by tightening a pair of clamps 166*a* and 166*b* which engage around tube 136 adjacent to bracket 162. This presses outer tube 136 against inner tube 138 thereby preventing relative sliding motion of those two members. It will be appreciated that the position of the pedal crank 26*a* can be adjusted by the pilot sitting in seat 12*a* even when the vehicle is underway if that becomes necessary because of leg fatigue or for some other reason.

As best seen in FIGS. 2 and 6B, the drive chain 28 referred to above is engaged around one of the sprockets 26*b* of the pedal crank 26*a*. The chain may be moved between the sprockets by actuating a shift lever 167 (FIG. 2) mounted to the tube 136 in front of pilot P. That chain has upper and lower runs 28*a* and 28*b* which extend downwardly rearwardly to, and engage under, a pair of side-by-side idlers 172 rotatably mounted to the transverse frame member (82*i*) at the bottom of frame 12 under seat 12*a* and thence under a second pair of idlers 174 mounted to another transverse frame member (82*h*) connected between the side section couplings 44*h*. From there, the chain extends to a derailleur and differential mechanism to be described in more detail later which rotates the vehicle's rear sheaves 24 that circulate the vehicle's flotation tracks 18. If necessary, a longitudinal slot 175 (FIG. 3) may be provided in the floor panel 16 under seat 12*a* to provide clearance for the chain runs 28*a* and 28*b* extending between the idlers 172 and 174.

The Support For The Front Sheaves 22

Referring now to FIGS. 4, 7A and 7B of the drawings, the front sheaves 22 of the vehicle are mounted to the vehicle frame 12 by means of a pair of mirror-image front axle assemblies 182 only one of which is shown. As will be seen, these assemblies are removably attached to the frame side sections 42 of the vehicle. Each assembly 182 includes a tubular member 184 having a plug 186 roll beaded into one end of that member. The opposite end of the member is closed by an axle 188 whose base 188*a* is roll beaded into the end of the tubular member. The axle 188 is shaped to receive and support the hub 22*a* of a front sheave 22 as shown in FIG. 7B. The sheave may be secured to the hub by a nut 190 threaded onto the end of the axle 188. Each nut may be secured by a short wire 191 connected between the nut and axle and protected by a cover 191 a which plugs into the end of the wheel hub 22*a* which free wheels on that axle.

Surrounding the axle end of the tubular member 184 is a three node axle strut coupling 192. Coupling 192 is basically a ring with three roll bead-type branches or nodes angled away from axle 188 about 45° and spaced at equal angles about the axle axis. The end of the tube 184 containing the plug 186 is arranged to snugly engage in the sleeve fitting 54 of frame side section 42 and is releasably held there by means of a spring-loaded pin 194 which is incorporated into the side of the coupling 54 and which projects into a lateral passage 196 in plug 186. The pin 194 may be withdrawn from passage 196 to quickly release tube 184 from the vehicle side frame 42 by pulling on a ring or lanyard 196 attached to pin 194 as shown in FIG. 7A.

Identical tubular struts 198 are mounted at one end to the three branches 192*a* of the coupling 192. The opposite end of each strut is roll beaded to the node 202*a* of a clamp member 202*b* which mates with a second clamp member 202*c*. Preferably, the two mating clamp members 202*b* and 202*c* may be engaged about opposite sides of a tubular frame member. The two clamp members 202*b*, 202*a*, may also include internal circular ribs 202*d* that may seat in the roll beaded groove 52*a* (FIG. 5A) of that tubular member as best seen in FIG. 7B. The members 202*b*, 202*c* may be clamped about the tubular member by tightening a threaded fastener 202*e* extending through frame member 202*c* and threaded into member 202*b*. This roll beaded split clamp construction with the quick release coupling 54 nicely transfers the sheave 22 loads to the vehicle frame 12, yet allows the front axle to be replaced quickly and easily if that becomes necessary.

In the illustrated aquatic vehicle, the three struts 198 of each front axle assembly 182 are connected by their respective clamp members to tubular members 52, 56 and 58 of the corresponding vehicle side section 42. When assembled as shown, the axle assemblies 182 provide extremely strong rotary supports for the vehicle's free wheeling front sheaves 22*a*. Yet, should an assembly 182 become damaged or if it is necessary to remove the assembly from the vehicle frame 12 for some reason, this may be accomplished simply by releasing the clamp members 202*b*, 202*c* from the frame members to which they are clamped, retracting pin 194 and pulling tubular member 184 from the coupling 54 and then replacing the damaged assembly with a new one. Thus, a front axle replacement can be done very quickly and efficiently and without requiring any special tools, welding equipment or the like.

The Support For The Rear Sheaves 24

Figure 8A:
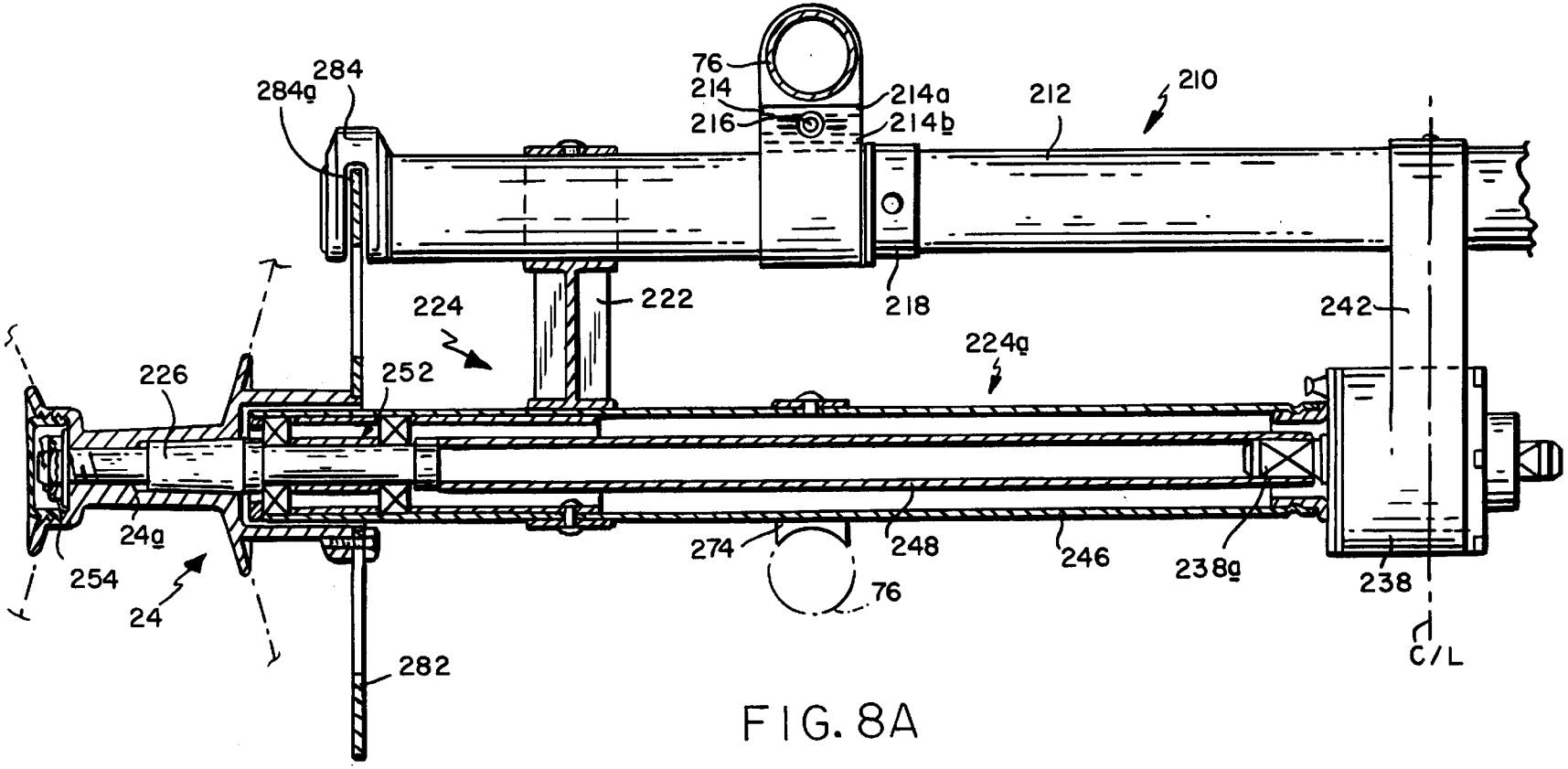
FIG. 8A is a longitudinal sectional view with parts shown in elevation of the right side of the vehicle's rear axle and suspension assembly.
Figure 8B:
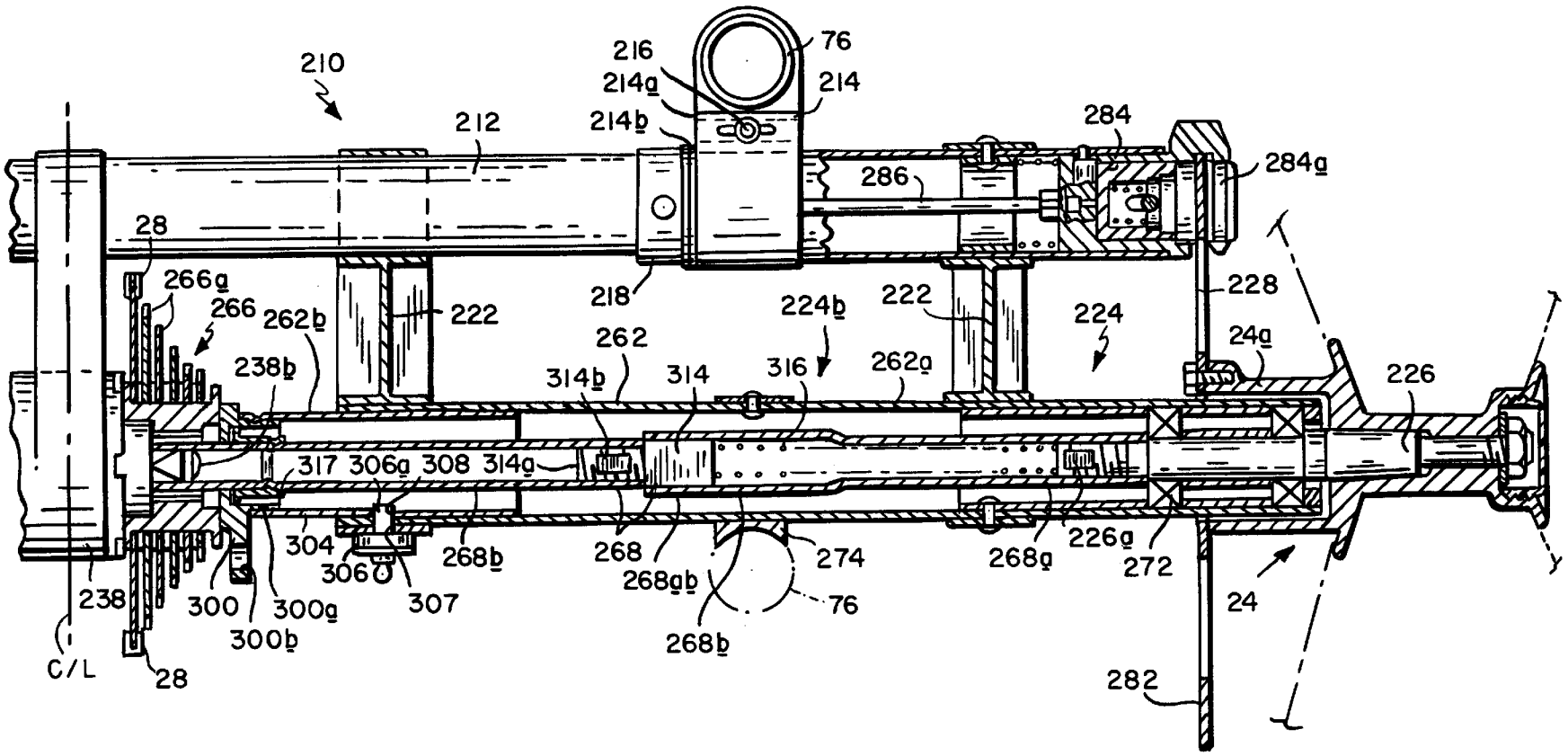
FIG. 8B is a similar view of the left side of that assembly.

Referring now to FIGS. 2, 3, 8A and 8B, the vehicle incorporates a rear suspension, shown generally 210, the left side of the suspension being detailed in FIG. 8A, the right side in FIG. 8B. The suspension 210 supports the rear sheaves 24 in such a way as to apply tension to the vehicle's flotation tracks 18 when the vehicle is being used, but to allow the tracks to be slackened when it is necessary to repair or replace the tracks. Suspension 210 comprises a transverse tubular member 212 which extends between, and is rotatably connected to, the vehicle's frame side sections 42. More specifically, member 212 is slidably received in a pair of quick release sleeve brackets 214 clamped to the tubular frame members 76 of the two side sections 42. Each bracket 214 is composed of a pair of sections 214*a* and 214*b* which are keyed together so that the two sections can slide relatively in the direction of the member 212 axis. The two sections may be releasably locked together by a pin 216 which may be pulled out when it is desired to separate tubular member 212 from frame 12. Axial motion of member 212 relative to brackets 214 is prevented by collars 218 fastened to member 212 adjacent to the inboard sides of brackets 214. However, the tubular member 212 is free to revolve about its axis within the sleeve brackets sections 214*b*.

Spaced along the length of tubular member 212 is a plurality of hanger brackets 222 which are fixed to rotate with tubular member 212. These brackets 222 rigidly support a transverse tubular rear axle assembly shown generally at 224 whose opposite ends are terminated by rear axles 226 that are designed to support the vehicle's rear sheaves 24.

Rear axle assembly 224 is composed of left and right segments 224*a* (FIG. 8A) and 224*b* (FIG. 8B) connected end-to-end by a differential 238 mounted to the tubular member 212 by a hanger bracket 242. As shown in FIG. 8A, the axle segment 224*a* is composed of a radially outer tubular member 246 one end of which is connected to the housing of differential 238 and the other end of which extends through and is supported by a hanger bracket 222. The axle segment 224*a* also includes an inner tubular shaft 248 extending coaxially within tubular member 246. One end of shaft 248 is connected to one output 238*a* of the differential 238. The opposite end segment of the shaft is rotatably supported within the outer tubular member 246 by a bearing assembly 252 and is terminated by an axle 226. The hub 24*a* of a rear sheave 24 may be engaged to that axle and secured thereto by a nut 254 threaded onto the end of the axle. A security wire and end cap similar to the ones on the front axle assemblies 182 may be provided to secure each nut 254.

As shown in FIG. 8B, the right segment 224*b* of the rear axle assembly 224 is composed of a radially outer tubular member 262 supported by a pair of spaced apart hanger brackets 222. The inboard end of tubular member 262 is mounted concentric to differential 238 through a more or less standard multiple gear derailleur and free wheel assembly shown generally at 266. The rear axle assembly segment 224*b* also includes an inner tubular shaft 268. The inboard end of that shaft extends through assembly 266 and connects to a second output 238*b* of differential 238. The outboard end segment of shaft 268 is rotatably supported within member 262 by a bearing assembly 272 mounted in the outboard end of tubular member 262. The free end of shaft 268 is terminated by an axle 226 to which is mounted the hub 24*a* of the right rear sheave 24.

The vehicle's drive chain 28 is arranged to engage around one of the gears 266*a* of the assembly 266. When the vehicle is in operation, the pilot P may move the chain 28 from one gear to another by actuating a shift lever 268 (FIG. 2) mounted to the tube 136 of the pedal crank assembly 26 and connected by a cable in the usual way to the derailleur and free wheel assembly 266.

The entire rear axle assembly 224 is thus swingable about the axis of tubular member 212 between a lower forward position shown in phantom in FIG. 2 and an upper over center position shown in solid lines in that figure wherein the rear axle assembly 224 locks up against the undersides of the two frame side section members 76. To prevent undo wear on the tubular members 246 and 262 of the assembly, annular pads or seats 274 may be secured to these tubular members at those points of engagement with frame members 76. When assembly 224 is moved to its lower dotted line position in FIG. 2 the sheaves 24 are swung forward and thus, the flotation tracks 18 are slackened and may be removed from sheaves 22 and 24 for repair or replacement. On the other hand, when that assembly is in its solid line upper overcenter position shown in FIG. 2, the tracks 18 are maintained under tension between the front and rear sheaves 22 and 24. The weight of the vehicle and its Pilot is used to assist rotating assembly 224 to this heavily tensioned slightly over center position of assembly 224.

If desired, the rear axle assembly 224 may be positively maintained in that upper position by lashing it to the frame members 76.

It should be noted that with the flotation tracks 18 removed from body 10, one may grasp frame 12 by the front cross tube 82*e* and lift the front end of the vehicle slightly and push or pull the vehicle on its rear sleaves 24 to and from the shore or waterline. This may be made easier if the rear assembly 224 is in its lower dotted line position shown in FIG. 2.

The ability to remove tracks 18 from the vehicle body 10 quickly and easily also allows one to lift the remaining lightweight structure onto a conventional automobile roof rack for long distance transportation to the shore line. The vehicle may be secured by lashing or clamping the cross tubes 82*j* and 82*h* to the car top rack. In this event, the telescoping mast 34 may be moved to its collapsed position.

It is also a feature of the vehicle that the rear suspension 210 may be spaced along the tubular members 76 to adjust the over center clamping action of the rear axle assembly 224 at seats 274. A similar adjustment may be made when it is desired to lengthen tracks 18 by adding more flotation treads 18*a* in order to increase the buoyancy of the vehicle so that the vehicle can carry more weight.

When the rear axle assembly 224 is in its operative upper position shown in solid lines in FIG. 2 and drive chain 28 is advanced by the pedal crank 26*a*, the operative gear of the derailleur in assembly 266 is rotated which causes the shafts 248 and 268 and the sheaves connected thereto to rotate. As noted above, assembly 266 incorporates a free wheel feature so that if the pilot P stops pedaling, the drive shafts and sheaves may continue to rotate so that tracks 18 may continue to advance allowing the vehicle to "coast". The differential 238 controls the rotations of the two shafts 248 and 268 so that if one shaft is slowed by braking, the speed of other shaft will increase proportionally. Thus, by braking one or both of shafts 248, 268 and the sheaves connected thereto, the pilot P may turn the vehicle to port or to starboard or bring the vehicle to a halt.

For steering and stopping the vehicle as aforesaid, brake discs 282 are mounted to the sheave hubs 24*a*. These brake disks may be engaged selectively by the calipers 284*a* of a pair spring-loaded, hydraulically actuated caliper brakes 284 mounted in the opposite ends of the tubular member 212 so that the brake mechanisms are protected and so that the braking forces are tightly coupled to the frame 12. Brakes 284 may be similar to those used on advanced bicycles. The brakes include brake lines or tubes 286 which lead to a pair of fluid pumps which when actuated push fluid through the lines to the brakes. By squeezing one or the other pump (brake) handle 288*a* or 288*b*, mounted to tubular member 122 in front of pilot P (FIG. 2), the pilot, while pedaling, can actuate one or the other caliper brake 284. Actuating the starboard brake will cause the vehicle to turn to starboard; actuating the port brake will cause the vehicle to move to port. Actuating both brakes will stop the motion of both tracks 18.

My rear axle assembly 224 is advantaged also in that it allows for the quick repair and replacement of the derailleur and free wheel assembly 266 if that becomes necessary. More particularly, as best seen in FIG. 8B, the outer tubular member 262 of the rear axle assembly segment 224*b* is actually composed of two telescoping tube segments 262*a* and 262*b*. Segment 262*a* is relatively long and extends from the right axle 226 through the hanger bracket 222 located adjacent to the derailleur and free wheel assembly 266. The shorter segment 262*b* extends from within segment 262*a* to the derailleur assembly. Its end adjacent to that assembly is mostly closed by an annular end cap 300 which has a neck 300*a* roll beaded into the end of tube segment 262*b*. An eye 300*b* is provided in cap 300 to secure the rear derailleur mechanism (not shown). A spring-loaded pin mechanism 306 is mounted to the hanger bracket 222. That mechanism has a radially inwardly extending pin 306*a* which projects through a hole 307 in segment 262*a* and may engage in a similar hole 308 formed in the wall of segment 262*b* to fix the axial positions of those two segments. The pin may be retracted from hole 308 to allow segment 262*b* to be retracted about 1.5–2 inches into segment 262*a* by pulling on the end caps 300 mounted to the end of segment 262*b*.

The tubular shaft 268 is also a telescoping member. More particularly, the shaft includes an outboard tubular segment 268*a* one end of which is screwed onto the inner end of axle 226 and flattened against a flat 226*a* formed on the axle to positively lock the segment and shaft together. The opposite or inboard end segment of shaft segment 268*a* is squared off at 268*ab*. Slidably received in the squared off inboard end segment 268*ab* is a coupling 314 having a square crossection. Coupling 314 has a screw extension 314*a* which is screwed into one end of a second or inboard shaft segment 268*b*. The wall of segment 268*b* is pressed against a flat 314*b* on coupling extension 314*a* to lock those members together.

The shaft segment 268*b* extends inboard through the central opening of end cap 300 and connects to the output shaft 238*b* of differential 238.

A coil spring 316 is compressed between coupling 314 and the inner end of the right axle 226 so that the coupling and the shaft segment 268*b* to which it is connected are urged toward the differential 238 whereby shaft segment 268*b* remains in driving engagement with the differential output shaft 238*b*. The axial extension of shaft segment 268*b* is limited by a collar 317 which is rotatably fixed to shaft segment 268*b* just outboard of the end cap 300 that is fixed to the inboard end of tubular member segment 262*b*.

To release the derailleur and free wheel assembly 266, the pin 306*a* may be pulled out which allows the tubular member segment 262*b* to be retracted into segment 262*a* and away from assembly 266. Because end cap 300 now engages the collar 317, the shaft segment 268*b* is also retracted away from differential shaft 238*b* in opposition to the bias provided by the spring 316. This allows the entire derailleur and free wheel assembly 266 to be disengaged quickly and easily from the differential 238 in the event that repair or replacement of that assembly is required. When a new assembly 266 is in place in the differential housing tubular member segment 262*b* may be extended until pin 306*a* snaps into hole 308. The extension of that segment also allows shaft segment 268*b* to extend into driving engagement with the differential output shaft 238*b* under the influence of spring 316.

The Flotation Tracks 18

Figure 9B:
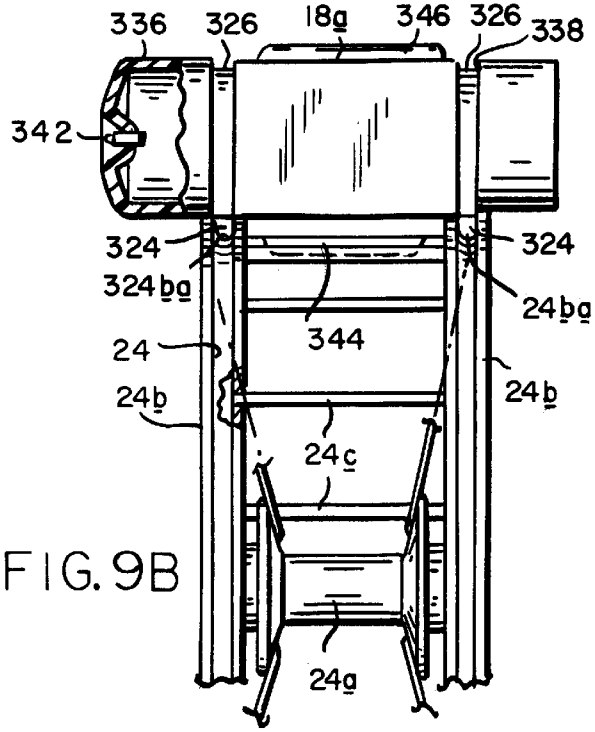
FIG. 9B is a sectional view taken along line 9B—9B of FIG. 9A.
Figure 9A:
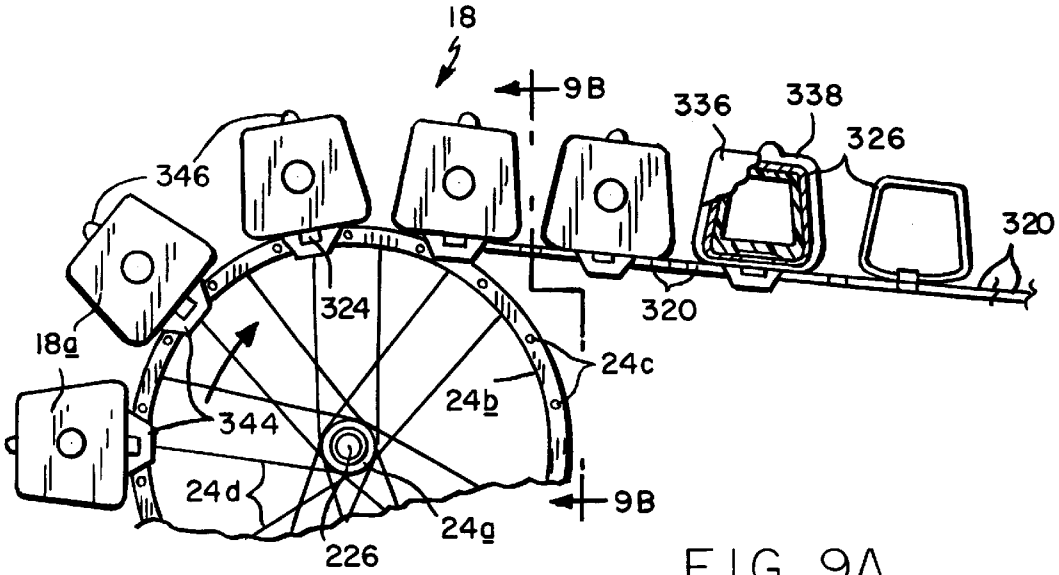
FIG. 9A is a fragmentary side elevational view with parts broken away showing one of the vehicle's flotation tracks in greater detail.

Referring now to FIGS. 9A and 9B, each rear sheave 24 comprises, in addition to a hub 24*a*, a pair of circular metal, e.g., aluminum, rims 24*b* each of which has a circumferential V-groove 24*ba*. The rims are maintained in spaced apart parallel relation by a multiplicity of cross tubes 24*c* whose opposite ends are counterbored into and secured to the two rims at equally spaced apart locations around the rims as shown in FIG. 9B so as to form a squirrel cage. The two rims 24*b* of each sheave are connected to opposite ends of hub 24*a* by a multiplicity of wire spokes 24*d* similar to the spokes found in a conventional bicycle wheel. The illustrated sheave 24 is in the order of 23 inches in diameter and has 18 cross tubes 24*c* spaced about 4 inches apart center to center around rims 24, the rims being connected to hub 24*a* by 36 spokes, 18 spokes extending from each rim to each side of hub 24. The tensioned spokes 24*d* hold the cross tubes 24*c* in compression and the resulting sheave is precision trued and balanced for high speed operation.

As best seen in FIG. 4, each front sheave 22 is similar to a rear sheave 24 except that its rims 22*b* with grooves 22*ba* have a smaller diameter, i.e., about 18 inches, and thus the sheaves require only 14 cross tubes 22*c* spaced 4 inches apart. Thus, the pitch of cross tubes 22*c* is the same as that of cross tubes 24*a*. The rims 22*b* are connected to hub 22*a* by 28 spokes, 14 spokes extending from each rim 22*b* to each side of hub 22*a*. Since the front sheaves are smaller than the rear sheaves, their axles 188 (FIGS. 7B) are located on the vehicle frame 12 about 2.5 inches below the rear axles 226 so that the lowermost portions of all of the sheaves lie in a common plane as shown in FIG. 4.

As noted above, the flotation tracks 18 are stretched between the front and rear sheaves 22 and 24 at opposite sides of the vehicle. Each flotation track 18 comprises a pair of non-stretchable stainless steel cable loops 320 engaged around the rims 22*b*, 24*b* of a front and rear sheave pair. In other words, there are two cable loops stretched between the front and rear sheaves at each side of the vehicle. Mounted to each cable 320 at equally spaced apart locations thereallong is a series of rigid drive nodes 322 for the flotation track. Also secured to each cable loop 320 between nodes 322 is a series of float attachment nodes 324 to which are attached flexible attachment bridles or bands 326, e.g., polypropylene webbing.

Figure 10B:
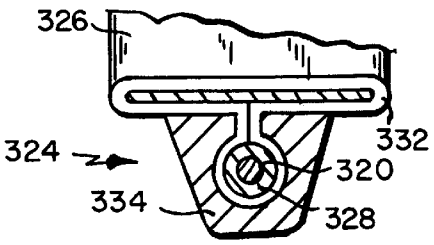
FIG. 10B is a sectional view on a larger scale taken along line 10—10B of FIG. 10A.
Figure 10A:
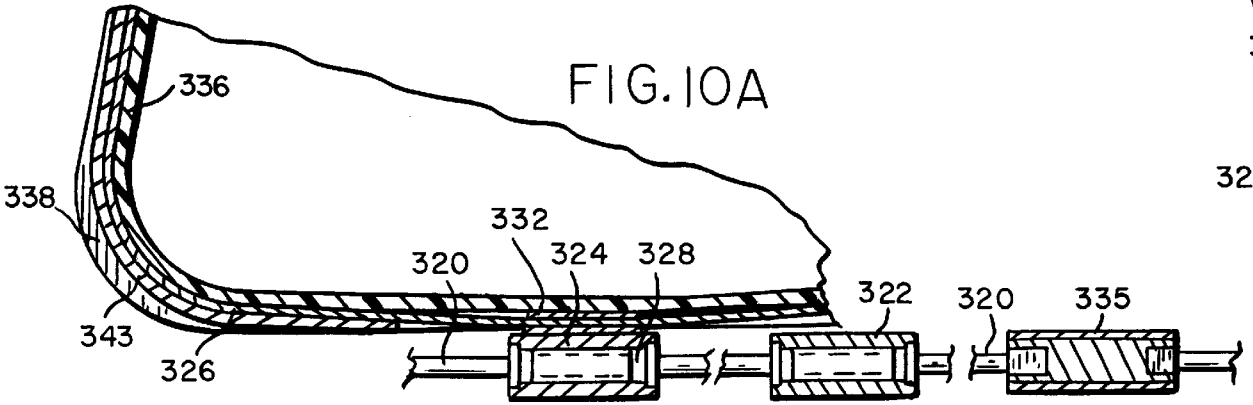
FIG. 10A is a fragmentary sectional view with parts in elevation showing in detail the connection of a flotation tread to the vehicle's flotation track.

As shown in FIGS. 10A and 10B, each attachment node 324 comprises a rigid spool 328, e.g., of aluminum. A strong web 332 is sewn around the spool and around bridle 326 and then a lug 334 of relatively pliable material such as polyurethane or the like is cast around the spool and the web. As best seen in FIG. 10B, each lug 334 has a wedge-shaped crossection which is arranged to seat in the wedge-shaped grooves 22*ba* and 24*ba* present in the sheave rims 22*b* and 24*b*, respectively. The lugs are softer than the rim material so that they frictionally engage, but do not mar, the rims.

The drive nodes 322 are similar to the attachment nodes except they lack the attachment web 332. Both types of nodes wedge into the rim grooves so that slippage is minimal.

It should be mentioned at this point, that a splice connector 335 (FIG. 10A) may connect the opposite ends of the cable that forms each cable loop 320 of a flotation track 15. If desired, the connector 335 may be formed of mating parts which can be releasably connected together to facilitate installing and removing the cable loops.

The attachment bridles 326 connected to the cable loops 320 comprising each flotation track 18 are designed to engage around opposite end segments of a flotation tread 18*a*. The bridles that capture treads 18*a* should be tough, yet flexible enough to repeatedly flex around the sheaves 22 and 24 in water and weather without suffering fatigue distress and/or causing damage to the thin-walled flotation treads 18*a*. The bridles should also maintain the treads 18*a* in a precise dimensioned network that points the treads ahead in a high speed environment.

As shown in FIGS. 4, 9A and 9B, each flotation tread 18*a* has an elongated, hollow body 336 which is generally rectangular or slightly trapezoidal along its length. Typically, the body is about 15×7×7 inches and may be of low or high density polyethylene. Each body 336 is appreciably longer than the widths of sheaves 22, 24 and each body 336 is formed with a pair of peripheral constrictions 338 spaced apart along the body more or less the same distance as the spacing of the rims 22*b*, 24*b* comprising each sheave 22, 24.

Preferably, just as with a boat oar, it is desirable to dip the flotation treads 18*a* into and remove them from the water, edge first, to minimize pounding (entrance) and suction (exit) forces and the float bodies 336 are shaped to do that as shown from the leading and trailing treads 18*a* in FIG. 2.

Preferably, each tread body 336 is hollow, flexible and at least partially collapsible so that spare treads can conveniently be stored on board the vehicle. The body is also inflatable so that it can be filled with a gas such as air or helium to make a tread quite firm. The illustrated body 336 is fluid tight so that it constitutes a tubeless float which may be filled with gas through a suitable valve 342 at the end of the body. The body 336 could also be fluid pervious in which case an inner tube (not shown) may be provided to inflate the body. In either event, in emergency situations, damaged flotation treads 18*a* may be filled quickly with foam displacing whatever water has entered body 336. Although, the treads 18*a* may be heavier, being foam filled, this would enable the vehicle to return to shore albeit at a reduced speed.

Each body tread 18*a* may be mounted to the flotation track 18 at least partially by deflating the body 336 and inserting it within the corresponding pair of bridles 326 of the flotation track such that the bridles engage in the body constrictions 338. Then, the body 336 can be inflated until the bridles tightly engage around the body thereby securing it to the pair of cables 320 comprising the particular flotation track 18. Desirably, as shown in FIG. 10A, a stiff metal anti-rotation clip or band 343 is adhered, sewed or otherwise secured to each bridle 326 where it engages around the two corners of the tread 18*a* adjacent to the attachment node 324 to prevent the tread from bending or rotating about its axis when the track 18 is advanced. A flotation tread 18*a* can be removed and replaced even when the vehicle is in the water by rotating the track 18 to bring the damaged tread to the top of the water and simply deflating the damaged tread, disengaging that tread from the bridles 326, inserting a new deflated tread into the bridles and inflating that new tread using 1) the pilot's breath or 2) a small onboard bicycle pump for higher pressures.

Of course in very large vehicles, the flotation treads 18*a* may be of a rigid material such as aluminum or carbon fiber composite and the bridles 326 may have a buckle type connection to cinch the treads 18*a* tightly to cables 320.

As best seen in FIGS. 4, 9A and 9B, each flotation tread body 336 also includes a longitudinal driving rib or boss 344, about 1.5 inches high, which extends from the broad face of body 336 between the body's two constrictions 338. Rib or boss 344 has a generally trapezoidal crossection and the rib is dimensioned to fit in the spaces between adjacent cross tubes 22*c*, 24*c* of the front and rear sheaves 22, 24. A similar, but somewhat smaller, e.g., ¾ inch, pushing rib or boss 346 projects from the opposite or outer face of body 336. Rib or boss 346 pushes against the water or ground when the flotation track 18 is circulated so as to help propel the vehicle in the water or onto a typical sloped beach.

The two endless cables 320 comprising each flotation track 18, each carrying a compliment of flotation treads 18*a*, may be mounted to the corresponding front and rear sheaves 22 and 24 by moving the vehicle's rear axle assembly 224 to its lower dotted line position shown in FIG. 2 as described above. This shortens the distance between the front and rear sheaves 22, 24 thereby allowing the endless cables 320 to be engaged around the rims 22*b*, 24*b* of those sheaves so that the drive nodes 322 and drive/attachment nodes 324 on each cable seat in the V-grooves 22*ba*, 24*ba* and so that the drive rib or boss 344 of each flotation track 18*a* fits between the cross tubes 22*c*, 24*c* of the front and rear sheaves 22, 24, thereby creating cogs. This interfitting engagement of the flotation track 18 to the sheaves 22 and 24 prevents any slippage between the flotation track and the sheaves. Thus, when the rear sheave 24 is rotated through a selected angle $\theta$, the flotation track 18 will advance a distance $r\theta$, where r is the radius of the rear sheaves 24. As each track 18 advances or circulates, the drive ribs or bosses 344 of successive flotation treads 18*a* along the lower stretch of the track will be captured between the cross tubes 24*c* of the rear sheaves 24 so that the flotation track is always positively driven by the rear sheaves. The ribs or bosses 344 also keep the track cables 320 from "jumping" from the sheaves when operating in heavy waves or at high speeds or when moving up onto the beach. It should be mentioned that such cable dislodgment was a big problem that was never completely solved in the case of existing bicycle sprocket-cable drives of the type used in human powered air craft.

The Wind Power Means 32

Figure 11A:
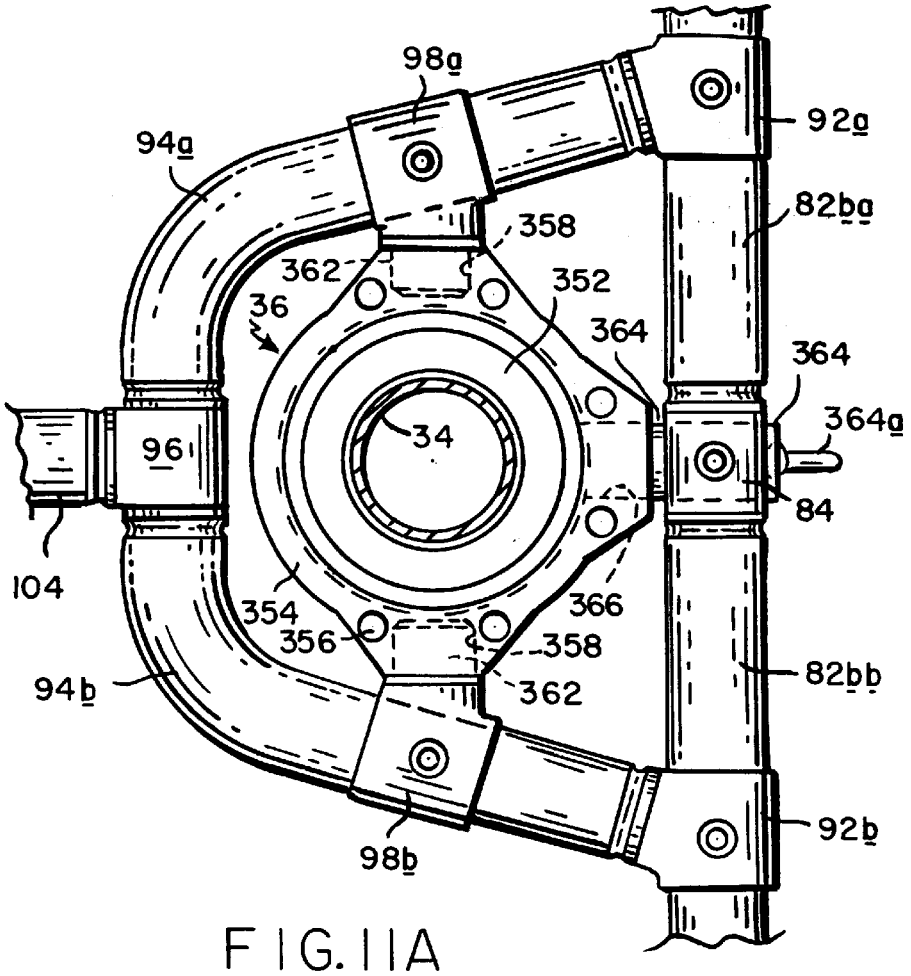
FIG. 11A is a fragmentary top plan view showing the vehicle's mast support assembly in greater detail.
Figure 11B:
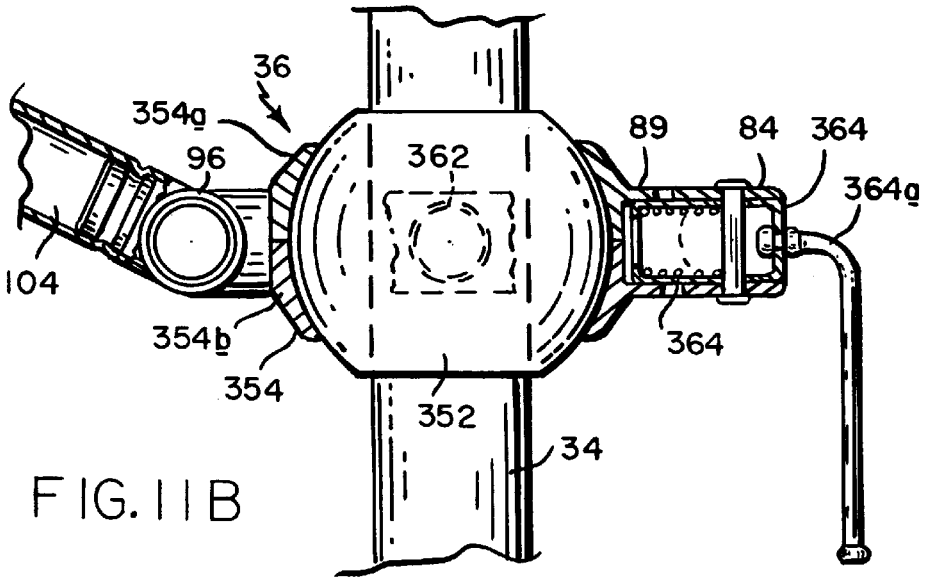
FIG. 11B is a sectional view showing the mast gimbal in the FIG. 11A assembly.

Referring to FIGS. 11A and 11B, mast 34 may be in the order of 16 feet long and may be in two or more sections to facilitate transporting the vehicle. Preferably, it is made of a very strong lightweight material such as carbon fiber or tapered aluminum tubing. A ball 352 of relatively large diameter, e.g, 4 inches, encircles the mast near its lower end.

The ball may be anchored to the mast by epoxy resin or other suitable means. Ball 352 can swivel in an annular socket 354 composed of upper and lower mating sections 354*a* and 354*b* which may be clamped together by bolts 356 to capture ball 352. This ball and socket connection allows the ball 352 to rotate and tilt in all directions about the ball centerpoint so that the mast 34 can be tilted in any direction and also be rotated about the mast axis as shown in FIGS. 1A to 1C.

The socket sections also include side channels 358 which are arranged to rotatably receive pins 362 projecting toward one another from pivot brackets 98*a* and 98*b*. When the upper and lower socket sections 354*a* and 354*b* are clamped together, those sections loosely capture pins 362 so that the socket 354 and the mast 34 which it supports are gimbaled and can be pivoted fore and aft relative to the vehicle frame 12. Normally, the socket 354 is maintained in a slightly tilted position shown in FIG. 2 wherein the mast 34 reposes in an upstanding raked position shown in solid lines in FIG. 1A. This position of the socket may be fixed by a spring-loaded pin 364 incorporated into coupling 84 which pin is arranged to engage in a lateral passage 366 in the front of socket 354 formed by channels in the socket sections 354*a* and 354*b*. Pin 364 may be retracted from socket 354 by pulling a lanyard 364*a* attached to the pin. This releases the socket and allows mast 34 to be swung down to and secured at its stowed position shown in dotted lines in FIG. 1A.

Figure 12:
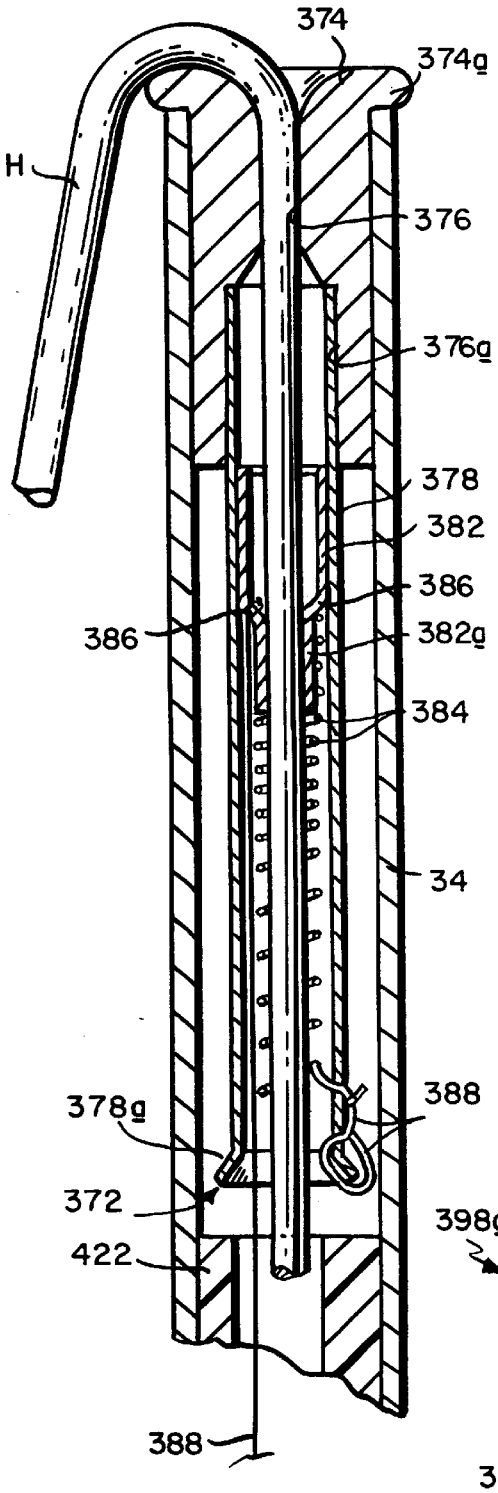
FIG. 12 is a longitudinal sectional view showing the upper end segment of the vehicle's mast.

Referring now to FIG. 12, the mast 34 is topped off by a special halyard clutch assembly shown generally at 372 which is inserted into the top of the mast. Assembly 372 includes an annular plug 374 internally flared at the top end which is press-fit into the opening in the top of the mast. Plug 374 has a circumferential flange 374*a* which seats on the top of the mast. The plug also has an axial passage 376 for slidably receiving the halyard H used to raise the vehicle's sail 38. That passage 376 is provided with a counterbore 376*a* extending up from the underside of plug 374 for receiving the upper end of a tube 378 which protrudes down into the mast and is terminated by a lower end flare 378*a*. The plug 374 may be anchored to the mast and the tube 378 maybe anchored to the plug by epoxy resin or other suitable means.

Slidably positioned within tube 378 is a tubular slider 382. Slider 282 has a reduced diameter lower segment 382*a* which is surrounded by the upper end segment of a braided tube 384. The upper end of the braided tube 384 is connected to the slider 382 by stitches 386 which extends through suitable openings (not shown) in the slider 382. The braided tube 384 extends down through tube 378 and the lower end of the braided tube is connected by appropriate stitching 388 to the lower end of tube 378. As shown in FIG. 12, the halyard H extends up through the braided tube 384 and through the axial passage 376 in plug 374 over the top of the mast and down to the sail clew (not shown).

The braided tube 384 functions as a clutch for the halyard H. When the halyard is pulled upward within the mast, as when the windblown sail 38 is pulling on the halyard, the braided tube 384 lengthens. This decreases the diameter of that tube causing it to tightly engage or grip halyard H in the manner of a "Chinese finger grip" thereby preventing upward movement of the halyard within the mast.

To release the clutching action of the braided tube 384, a wire trip line 388 is connected at its upper end to the slider portion 282*a*. The trip line extends down the length of the mast 34 and its other end is made accessible to the pilot P. When the pilot pulls the trip line 388, this retracts the slider 382 and thus relaxes the braided tube 384 allowing the halyard H to move upwardly or downwardly within the mast in order to lower or raise the sail 38.

Thus, with the illustrated clutch assembly 372, the halyard H is only tensioned at the top so that the mast 34 can bend with the wind as designed. Also, it is not necessary to tie off the halyard in order to maintain the sail in its raised position. Rather, the clutch assembly 372 performs that function automatically. Then, when it becomes necessary to lower the sail 38, the pilot P needs only to pull on the trip cable 388. This automatically releases the clutch assembly and allows the halyard H to move freely up through the mast so that the sail 38 can be hauled down.

Figure 13A:
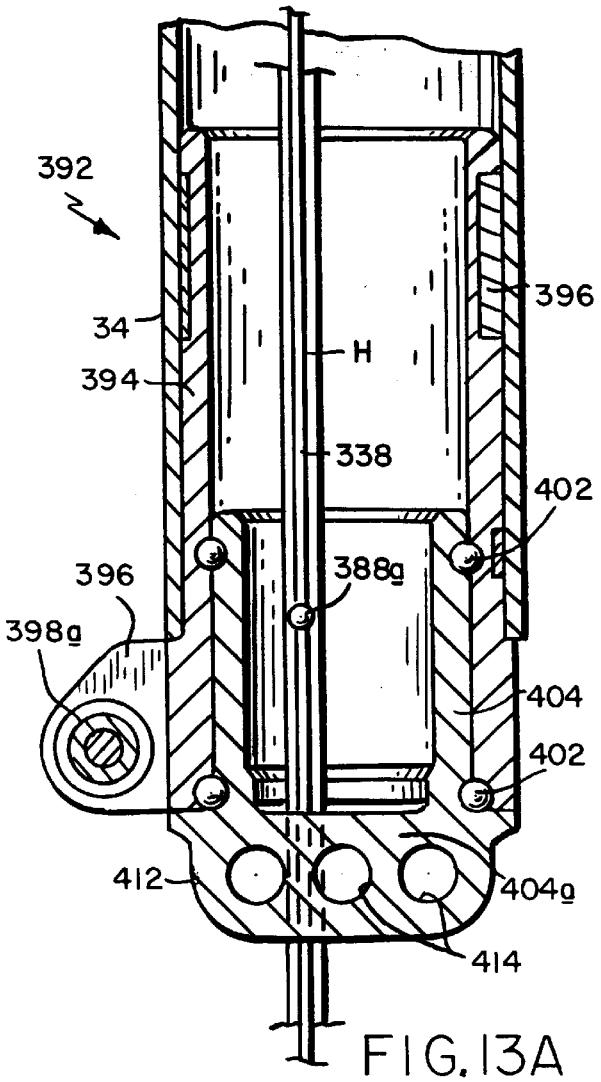
FIG. 13A is a similar view of the lower end segment of the mast.
Figure 13B:
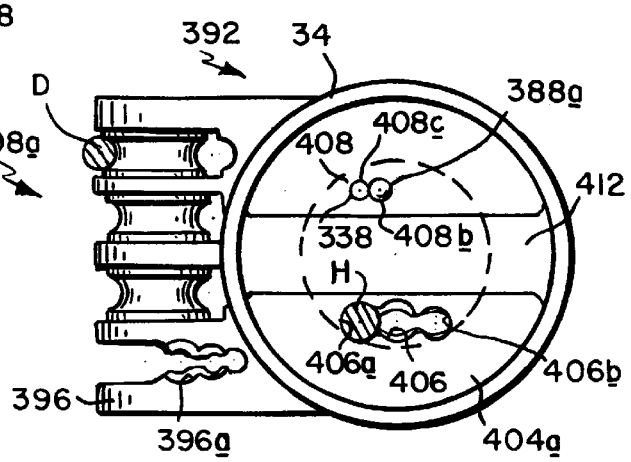
FIG. 13B is a bottom view of the vehicle's mast.

Referring now to FIGS. 13A and 13B, the lower end of mast 34 is terminated by a downhaul assembly shown generally in 392 which plugs into the lower end of the mast 34. Assembly 392 comprises a cylindrical housing 394 which is releasably retained within the mast by a conventional eccentric locking band 396. In other words, the eccentric locking band 396 interfits with the mast when the housing 394 is rotated about the axis of the mast and it may be withdrawn from the mast when the housing counter rotated to its initial position.

The lower end of housing 394 is formed with ears 396 which extend out laterally and contain a rope cleat 396*a* and support a series of sheaves 398. These sheaves constitute the lower pulley set 398*a* of a block and tackle for the downhaul line D that leads to the upper pulley set 398*b* connected to the sail foot as best seen in FIG. 2. This arrangement allows the pilot P sitting in the vehicle's seat 12*a* to tension the sail, bend the mast to create the desired sail aerodynamic shape.

Rotatably positioned within the lower end of housing 394 by way of bearings 402 is a swivel head 404. The swivel head closes off the bottom of mast 34 and has a bottom wall 404*a*. As best seen in FIG. 13B, an opening 406 is formed in the housing bottom wall 404*a* for receiving the halyard H. Opening 406 forms a rope cleat or clutch in that the halyard can be moved between various sections of that opening which grip the halyard H to varying degrees. More particularly, the halyard can be moved between a passage section 406*a* which allows the halyard to slide freely up and down within mast 34 to a much smaller diameter section 406*b* which firmly grips the halyard and prevents it from moving within the mast.

There is also a second passage 408 in the housing bottom wall 404*a* for accommodating the trip cable 388. This passage also has a relatively large diameter section 408*a* which allows the cable 388 and a ball stop 386*a* affixed thereto to move freely up and down within the mast. The cable can be moved from that section 408*a* to a smaller diameter section 408*b* with a counterbore to grip the cable stop 388*a* so that the halyard clutch 372 is maintained in its releasing position.

As best seen in FIG. 13A, the swivel head 404 is formed with a depending ear 412 containing a plurality of holes 414. Various lines or cables (not shown) may lead from these holes 44 by way of conventional pulleys or other guide means back to the vicinity of the vehicle's seat 12*a*. By pulling on these lines, the pilot can tilt the mast 34 fore and aft and from side to side to the positions shown in FIGS. 1A and 1B without interfering with mast rotation. Similarly, the halyard H and the trip cable 388 can be guided back to the vicinity of the vehicle seat 12*a* to enable the pilot to raise and lower the sail 38. Similar cables may be attached to the free end of the boom 36 and guided to the vicinity of seat 12*a* to allow the pilot P to trim the sail 38.

Referring to FIG. 1A, the sail 38 is unique in that its leading or luff edge is formed with a zippered sleeve or pocket which loosely encircles the mast 34. The sleeve is provided with a full length zipper track 420 at the leading edge of the mast which extends the full length of the sail. Zipper sliders 420*a,* 420*b* and 420*c* are provided above and below boom 37. This arrangement along with the halyard clutch and downhaul assembly described above, allows the pilot to raise, reef, lower and remove the sail 38 from inside the vehicle and without having to lower the mast 34.

In some applications, the illustrated mast and sail can be exchanged for a rigid air foil or "wing mast" and sail as is known in the sailing art; in that event, the mast motions as described still apply.

If desired, the mast 34 may be partially filled with foam flotation material 422 as shown in FIG. 12 and/or the sail luff pocket may be partially filled with said material as shown at 424 in FIG. 1A. This will facilitate re-righting the vehicle in the event it capsizes as will be described presently.

Unlike other aquatic vehicles of the general type, in my vehicle, the pilot P is surrounded by 1) the "normally active buoyancy" beneath him due to the flotation treads 18*a* at the bottoms or lower segments of tracks 18 as well as 2) the "reserve buoyance" of the sides and the top of the vehicle due to the buoyant frame 12 and the flotation panels 16 and the flotation treads 18*a* at the tops or upper segments of tracks 18. Thus, the vehicle is unstable in the capsized condition. Should my vehicle capsize for any reason, it may immediately and temporarily float upside down on what was the upper float track segment with the lower track segment up in the air and the able buoyant mast 34 and sail 38 angled down in the water. If the pilot now moves "down" into seat 12*a*, his/her head can be above the water even in this embarrassing position.

However, this will not normally be necessary because the tiltable buoyant mast 34 and/or sail 38 automatically exert a re-righting moment on the vehicle so as to rotate the vehicle onto its side. In this position, either the entire port or starboard floatation track 18 is in the water providing more floatation treads 18*a* in the water than when the vehicle is in either its normal upright or a capsized position so that the pilot in seat 12*a* is floated totally out of the water and now lying on his/her side. Now, at his/her leisure, the pilot, while resting in place, can manipulate the tiltable mast 34 and sail 38 like a giant lever and, aided perhaps with some bodily rocking and wave action, quickly re-right the vehicle. No other boat on aquatic vehicle of this several type that we know of can be re-righted in this fashion, this easily.

It will thus be seen that the objects set forth above, among those made apparent from the preceding description are efficiently attained. Also, it should be understood that certain changes may be made in the above constructions without departing from the scope of the invention. For example, it is quite feasible to enlarge the frame 12 laterally so that the frame and the skin 14 surrounding the frame enclose the tops and sides of the flotation tracks 18. This reduces the drag over the tops of the flotation tracks 18 while tending to lift the vehicle out of the water and "drive" the flotation treads 18*a* at the bottoms of the tracks. It thus improves the aerodynamic characteristics of the vehicle and should allow it to perform better in racing competitions.

It is also possible to substitute for the caliper brakes in the illustrated vehicle, more or less conventional regenerative braking systems which function both to brake the vehicle and to charge on-board batteries which may power navigation equipment, radio gear, as well as an electric motor, in lieu of motor M, for propelling the vehicle.

The pedal drive may also power an air or water pump or the like to provide propellant for a paint ball gun or water cannon so that the vehicle can be used in "naval warfare" games and contests.

It is also possible to incorporate a clutch mechanism into the vehicle's differential or rear derailleur so that the tracks 18 may be operated independently. In this event, the brakes 284 may not be required.

Therefore, it is intended that all matter contained in the above description or shown in the accompanying drawings shall be interpreted as illustrative and not in a limiting sense.

It is also to be understood that the following claims are intended to cover all of the generic and specific features of the invention described herein.

What is claimed is:

1. An aquatic vehicle comprising a body having a front, a rear, a bottom and opposite sides and for containing a pilot;

a seat supported by said body adjacent to the bottom thereof;

a pair of front sheaves rotatably mounted to opposite sides of the body near the front of the body;

a pair of rear sheaves rotatably mounted to opposite sides of the body near the rear of the body;

a first flotation track engaged around and extending between the front and rear sheaves on one side of the body;

a second flotation track engaged around and extending between the front and rear sheaves on the other side of the body, each said flotation track including an endless band engaged around a front sheave and a rear sheave, a multiplicity of buoyant flotation treads and connecting means for connecting the treads to the band at spaced apart locations therealong to form upper and lower series of flotation treads extending between the associated front and rear sheaves;

drive means mounted to said body for producing an output torque, said drive means including a pedal crank releasably mounted to the body in front of said seat, and coupling means for coupling said torque to at least one of the sheaves on each side of said body so as to advance said tracks in order to propel the vehicle, said coupling means including a chain drive for coupling torque from the pedal crank to said at least one of the sheave on each side of the body.

2. The vehicle defined in claim 1 and further including means for selectively braking at least one of the sheaves on each side of the body so as to retard or stop the advance of one or both of said flotation tracks in, order to steer or stop the vehicle.

3. The vehicle defined in claim 1 wherein said lower series of flotation treads of both said flotation tracks are buoyant enough by themselves to maintain the bottom of the body above the water.

4. The aquatic vehicle defined in claim 1 wherein the coupling means include means for varying the torque coupled to said one sheave on each side of the body.

5. The vehicle defined in claim 1 and further including means for braking at least one of the sheaves on each side of the body.

6. The vehicle defined in claim 5 wherein the coupling means include a differential so that when said at least one sheave on one side of the body is braked, the said at least one sheave on the other side of the body accelerates.

7. The vehicle defined in claim 1 and further including means for releasing each tread from the band to which it is connected.

8. An aquatic vehicle comprising a body having a front, a rear, a bottom and opposite sides and containing a pilot, said body including a frame composed of a multiplicity of frame members and coupling means for coupling the frame members together end to end so that some of the frame members form a pair of spaced-apart mirror-image frame side sections and others of the frame members constitute cross members which connect the side sections together at corresponding points around the perimeters of said side sections;

a seat supported by said body adjacent to the bottom thereof;

a pair of front sheaves rotatable mounted to opposite sides of the body near the front of the body;

a pair of rear sheaves rotatable mounted to opposite sides of the body near the rear of the body;

a first flotation track engaged around and extending between the front and rear sheaves on one side of the body;

a second flotation track engaged around and extending between the front and rear sheaves on the other side of the body each said flotation track including an endless band engaged around a front sheave and a rear sheave, a multiplicity of buoyant flotation treads and connecting means for connecting the treads to the band at spaced apart locations therealong to form upper and lower series of flotation treads extending between the associated front and rear sheaves;

drive means mounted to said body for producing an output torque, and coupling means for coupling said torque to at least one of the sheaves on each side of said body so as to advance said tracks in order to propel the vehicle.

9. The vehicle defined in claim 6 wherein the frame members are tubes having hollow ends, and the coupling means comprise a multiplicity of connectors each of which has a plurality of branches telescoped snugly into the ends of the tubes to which it is coupled, each branch having a groove extending around its perimeter which mates with an internal bead formed in the tube coupled to that branch.

10. The vehicle defined in claim 7 wherein the frame members and coupling means are of a material selected from the group consisting of aluminum, titanium, magnesium, carbon fiber and plastic.

11. An aquatic vehicle comprising a body having a front a rear, a bottom and opposite sides and for containing a pilot;

a seat supported by said body adjacent to the bottom thereof;

a pair of front sheaves rotatable mounted to opposite sides of the body near the front of the body;

a pair of rear sheaves rotatable mounted to opposite sides of the body near the rear of the body, each sheave comprising a pair of circular rims each rim having a peripheral groove, a series of crossbars connected between said rims so that said rims are collinear, said crossbars being spaced an equal distance apart around said rims, a hub having opposite sides and being situated between said rims, and a multiplicity of spokes connecting the opposite sides of said hub to said rims so that said crossbars are maintained under compression and said spokes are maintained in tension to preserve the circularity of said rims;

a first flotation track engaged around and extending between the front and rear sheaves on one side of the body;

a second flotation track engaged around and extending between the front and rear sheaves on the other side of the body, each said flotation track including an endless band engaged around a front sheave and a rear sheave, a multiplicity of buoyant flotation treads and connecting means for connecting the treads to the band at spaced apart locations therealong to form upper and lower series of flotation treads extending between the associated front and rear sheaves;

drive means mounted to said body for producing an output torque; and coupling means for coupling said torque to at least one of the sheaves on each side of said body so as to advance said tracks in order to propel the vehicle.

12. The vehicle defined in claim 11 wherein the endless band of each flotation track comprises a pair of laterally spaced apart endless cables engaged in the grooves of the pair of rims comprising each sheave about which that band is engaged.

13. The vehicle defined in claim 12 wherein each flotation tread comprises a buoyant, generally rectangular flotation body having longitudinal corners and which spans the pair of cables comprising the endless band connected to that tread so that when that tread enters and leaves the water, a corner of the body is presented to the water surface.

14. An aquatic vehicle comprising a tubular frame having a front, rear, a bottom and opposite sides and defining an enclosure;

seat means mounted to the frame within the enclosure for supporting a pilot;

an endless flotation track mounted to each side of the frame, each flotation track being movable along a circulation path;

drive means supported by said frame for moving each flotation track along the corresponding circulation path;

an elongated mast having an upper end, a lower end and a longitudinal axis extending between said ends;

a sail attached to said mast;

means for movably mounting the mast to the frame so that the mast has a cone-shape locus of motion around an erect position wherein the mast extends up more or less perpendicular to the bottom of the frame, and fixing means for selectively fixing the position of the mast within said locus of motion.

15. The vehicle defined in claim 14 wherein at least one of the mast and sail is buoyant so that said at least one of the mast and sail renders the vehicle unstable when inverted and functions as an outrigger to cause the vehicle, when capsized, to float on one of said flotation tracks.

16. The vehicle defined in claim 15 wherein the mast is hollow and partially filled with a flotation material.

17. The vehicle defined in claim 15 wherein said sail includes a luff pocket encircling said mast.

18. A vehicle defined in claim 17 wherein said luff pocket is partially filled with flotation material.

19. The vehicle defined in claim 14 wherein said mounting means include a ball mounted to the mast so that the center of the ball is located on the longitudinal axis of the mast and a socket mounted to said frame and rotatably receiving the ball so that the ball and mast can be tilted in all directions relative to the frame and be rotated about the longitudinal axis of the mast, and the fixing means comprise one or more cables, each cable having a first end connected to the lower end of the mast and a plurality of separate tie off means for tying off each of said one or more cables so as to selectively fix the distance between the lower end of the mast and each of said plurality of separate tie off means.

20. The vehicle defined in claim 19 wherein the socket is pivotally mounted to the frame so that the socket can be pivoted between a first position wherein the mast is upstanding and a second position wherein the mast is laid down on the frame more or less parallel to the frame bottom, and means for releasably locking the socket in said first position.

21. The vehicle defined in claim 14 wherein the mast is hollow, and further including a halyard extending within the mast, a releasable halyard clutch mounted inside the mast at the top thereof and engaging said halyard, and releasing means connected to the halyard clutch for releasing the clutching action of the halyard clutch so that the halyard can be moved along within the mast.

22. The vehicle defined in claim 21 wherein the halyard clutch comprises a tubular slide mounted within the mast, a tubular slider slidably positioned within the slide, a flexible tube having one end connected to said slide and its opposite end connected to said slider, said halyard extending through said slide, slider and flexible tube so that when the halyard moves in a first direction within the mast, the flexible tube functions as a grip to stop such movement, and wherein said releasing means comprise means for moving the slider toward said one end of the flexible tube so as to relax the flexible tube lengthwise and increase its cross sectional area so that the flexible tube does not grip the halyard.

23. The vehicle defined in claim 21 and further including a downhaul assembly mounted within the lower end of the mast.

24. The vehicle defined in claim 14 wherein said vehicle also includes a pair of laterally extending front axles releasably mounted to the opposite sides of said frame near the front thereof, each front axle having an outer end, a transverse rear axle, mounting means for movably mounting the rear axle to said frame near the rear thereof, said rear axle having opposite ends, a pair of first sheaves rotatably mounted to the outer ends of the front axles, a pair of rear sheaves rotatably mounted to the opposite ends of the rear axle, said pair of flotation tracks being engaged around the front and rear sheaves on opposite sides of the frame, said rear axle being movable between a first position wherein the front and rear sheaves are spaced apart sufficiently to tension the flotation tracks and a second position wherein the front and rear sheaves are closer together so that said flotation tracks are loosened and removable from the associated sheaves, and means for releasably locking said rear axle in said first position.

25. The vehicle defined in claim 24 wherein said rear axle is pivoted to said frame so that said first position of the axle is a stable over-center position which maintains said flotation tracks under tension.

26. A flotation track for an aquatic vehicle comprising a pair of sheaves, means for rotatably mounting said sheaves in spaced-apart relation, each sheave including a pair of circular rims, each rim having a peripheral groove, a series of crossbars connected between said rims so that said rims are collinear, said crossbars being spaced an equal distance apart around said rims, a hub having opposite sides and being situated between said rims, and a multiplicity of spokes connecting the opposite sides of said hub to said rims so that said crossbars are maintained in compression and said spokes are maintained in tension to preserve the circularity of said rims, a first endless non-extensible cable engaged in the grooves of corresponding first rims of said pair of sheaves, a second endless non-extensible cable engaged in the grooves of corresponding second rims of said pair of sheaves, a multiplicity of buoyant flotation treads, and means for connecting said treads to said first and second cables at corresponding spaced-apart locations along said first and second cables so as to form an endless series of spaced-apart flotation treads which advance around said pair of sheaves when said pair of sheaves is rotated.

27. The flotation track for an aquatic vehicle defined in claim 26 wherein the connecting means include means for releasing each tread from said first and second cables.

28. The flotation track for an aquatic vehicle defined in claim 26 wherein the connecting means include a pair of bridles encircling each tread and means for securing each bridle to said first and second cables.

29. A flotation tread for an aquatic vehicle comprising a hollow elongated flotation body having four sides and four longitudinal corners and a pair of opposite ends;

a pair of perimeter constrictions at spaced-apart locations along the body and means for inflating the flotation body to increase its buoyancy.

30. The flotation tread defined in claim 29 and further including an elongated driving rib projecting from one side of the flotation body.

31. The flotation tread defined in claim 30 and further including a longitudinal pushing rib projecting from the opposite side of said flotation body.

32. The flotation tread for an aquatic vehicle defined in claim 29 and further including a pair of cables, and securing means for releasably securing said flotation body to said pair of cables.

33. The flotation tread for an aquatic vehicle defined in claim 32 wherein said securing means include a pair of bridles encircling said flotation body at said pair of constrictions, said bridles being connected to different ones of said pair of cables.

34. An aquatic vehicle comprising a body having a front, a rear, a bottom and opposite sides and for containing a pilot;

a pair of front sheaves rotatably mounted to opposite sides of the body near the front of the body;

a pair of rear sheaves rotatably mounted to opposite sides of the body near the rear of the body;

a first flotation track engaged around and extending between the front and rear sheaves on one side of the body;

a second flotation track engaged around and extending between the front and rear sheaves on the other side of the body, each said flotation track including an endless band engaged around a front and rear sheave, a multiplicity of buoyant flotation treads and connecting means for connecting the treads to the band at spaced apart locations therealong to form upper and lower series of flotation treads extending between the associated front and rear sheaves;

drive means mounted to said body for producing an output torque;

coupling means for coupling said torque to at least one of the sheaves on each side of said body so as to advance said tracks in order to propel the vehicle;

a mast;

mounting means for movably mounting the mast to the body so that the mast has a cone-shaped locus of motion around an erect position wherein the mast extends up more or less perpendicular to the bottom of the body, and means for selectively fixing the position of the mast within the locus of motion.

35. The vehicle defined in claim 34 wherein the mast can also be moved to a stowed position wherein the mast is laid down on the body more or less parallel to the bottom of the body.

36. An aquatic vehicle comprising a body having a front, a rear, a bottom and opposite sides and for containing a pilot, said body including a frame composed of a multiplicity of frame members and coupling means for coupling the frame members together end to end so that some of the frame members form a pair of spaced-apart mirror-image frame side sections and others of the frame members constitute cross members which connect the side sections together at corresponding points around the perimeters of the side sections and a flexible skin covering the frame side sections and cross members to minimize aerodynamic drag on the vehicle and to protectively enclose the pilot thereof;

a pair of front sheaves rotatably mounted to opposite sides of the body near the front of the body;

a pair of rear sheaves rotatably mounted to opposite sides of the body near the rear of the body;

a first flotation track engaged around and extending between the front and rear sheaves on one side of the body;

a second flotation track engaged around and extending around between the front and rear sheaves on the other side of the body, each said flotation track including an endless band engaged around a front and rear sheave, a multiplicity of buoyant flotation treads and connecting means for connecting the treads to the band at spaced apart locations therealong to form upper and lower series of flotation treads extending between the associated front and rear sheaves;

drive means mounted to said body for producing an output torque, and coupling means for coupling said torque to at least one of the sheaves on each side of said body so as to advance said tracks in order to propel the vehicle.

37. The vehicle defined in claim 36 wherein at least portions of the skin at the top and sides of the body are of a material that is transparent to visible light.

38. An aquatic vehicle comprising a body having a front, a rear, a bottom and opposite sides and for containing a pilot;

a pair of front sheaves rotatably mounted to opposite sides of the body near the front of the body;

a pair of rear sheaves rotatably mounted to opposite sides of the body near the rear of the body, each sheave including a pair of similar circular rims each rim having a peripheral groove, a series of crossbars connected between said rims so that said rims are collinear, said crossbars being spaced an equal distance apart around said rims, a hub having opposite sides and a multiplicity of spokes connecting the opposite sides of said hub to said rims so that said spokes are maintained in tension to preserve the circularity of said rims;

a first flotation track engaged around and extending between the front and rear sheaves on one side of the body;

a second flotation track engaged around and extending between the front and rear sheaves on the other side of the body, each flotation track including an endless band engaged around a front and rear sheave and being composed of a pair of laterally spaced apart endless cables engaged in the grooves of the pair of rims comprising each sheave about which that band is engaged, a multiplicity of buoyant flotation treads and connecting means for connecting the treads to the band at spaced apart locations therealong to form upper and lower series of flotation treads extending between the associated front and rear sheaves, each flotation tread comprising a flotation body connected by a said connecting means to the pair of cables comprising the endless band associated with that tread, and a driving rib which projects from said body and is shaped and arranged to engage in the spaces between the crossbars of the sheaves engaged by the endless band associated with that tread when the corresponding flotation track is advanced;

drive means mounted to said body for producing an output torque, and coupling means for coupling said torque to at least one of the sheaves on each side of said body so as to advance said tracks in order to propel the vehicle.

39. The vehicle defined in claim 38 wherein the connecting means comprise a multiplicity of attachment lugs mounted to each cable of said pair of cables at corresponding spaced-apart locations therealong, said attachment lugs being shaped and arranged to seat in the rim grooves of the associated sheaves so that the lugs do not slip relative to said associated sheaves when the flotation track is advanced, a pair of bridles tightly encircling each flotation tread, and fixing means for fixing the corresponding attachment lugs on said cable pair to the bridle pairs encircling different ones of said flotation treads.

40. The vehicle defined in claim 39 and further including a multiplicity of drive lugs mounted to each cable so as to alternate with the attachment lugs on that cable.

41. The vehicle defined in claim 39 wherein each said flotation tread is releasable from its associated pair of bridles.

42. The vehicle defined in claim 41 wherein each bridle comprises first and second bridle segments and means for releasably securing said segments together.

43. The vehicle defined in claim 41 wherein the flotation body of each flotation tread is at least partially collapsible so that the flotation tread can be disengaged from the associated pair of bridles.

44. The vehicle defined in claim 43 wherein each said flotation body is fluid-tight and inflatable/deflatable through a valve mounted in a wall of said flotation body.

45. The vehicle defined in claim 43 wherein the flotation body of each flotation tread is hollow, and further including an opening in a wall of said body for filling said body with flotation material and means for closing said opening.

46. The vehicle defined in claim 38 and further including a pushing rib projecting from a second side of said body opposite said first side thereof.

47. An aquatic vehicle comprising a body having a front, a rear, a bottom and opposite sides and for containing a pilot, said body including a seat adjacent to the bottom of said body;

a pair of front sheaves rotatably mounted to opposite sides of the body near the front of the body;

a pair of rear sheaves rotatably mounted to opposite sides of the body near the rear of the body;

a first flotation track engaged around and extending between the front and rear sheaves on one side of the body;

a second flotation track engaged around and extending between the front and rear sheaves on the other side of the body, each said flotation track including an endless band engaged around a front and rear sheave, a multiplicity of buoyant flotation treads and connecting means for connecting the treads to the band at spaced apart locations therealong to form upper and lower series of flotation treads extending between the associated front and rear sheaves;

drive means mounted to said body for producing an output torque, said drive means including a pedal crank and crank mounting means for mounting the pedal crank to said body in front of said seat, and coupling means including a chain drive for coupling said output torque from said pedal crank to at least one of the sheaves on each side of said body so as to advance said tracks in order to propel the vehicle.

48. The vehicle defined in claim 47 wherein said coupling means further include a differential mechanism connected between the chain drive and said at least one of the sheaves on each side of the body so that if one of said flotation tracks is slowed by braking, the other flotation track speeds up proportionally.

49. The vehicle defined in claim 48 and further including braking means for slowing or stopping the advance of one or both of said flotation tracks in order to steer or stop the vehicle.

50. The vehicle defined in claim 48 wherein said chain drive includes a front derailleur connected to said pedal crank and a rear derailleur coupled to said at least one of said sheaves on each side of the vehicle.

51. The vehicle defined in claim 47 wherein said crank mounting means comprise first and second telescoping members, means for mounting the first member to said body, means for mounting the pedal crank to said second member and means for releasably fixing the relative position of said first and second members.

52. A flotation track for an aquatic vehicle comprising a pair of sheaves;

means for rotatably mounting said sheaves in spaced-apart relation, each sheave including a pair of circular rims, each rim having a peripheral groove, a series of similar crossbars connected between said rims so that said rims are collinear, said crossbars being spaced in equal distance apart around said rims, a hub having opposite sides, and a multiplicity of spokes connecting the opposite sides of said hub to said rims so that said spokes are maintained in tension to preserve the circularity of said rims;

a first endless non-extensible cable engaged in the grooves of corresponding first rims of the front and rear sheaves;

a second endless non-extensible cable engaged in the grooves in corresponding second rims of the front and rear sheaves;

a multiplicity of buoyant flotation treads, each flotation tread comprising a flotation body and a longitudinal driving rib which projects from said body between said pair of cables and is shaped and arranged to engage in the spaces between the crossbars of said sheaves, and means for connecting said treads to said first and second cables at corresponding spaced-apart locations along said first and second cables so as to form an endless series of spaced-apart flotation treads which advance around said pair of sheaves when said sheaves are rotated.

53. The flotation track defined in claim 52 wherein the connecting means comprise a multiplicity of relatively soft attachment lugs mounted to each cable of said pair of cables at corresponding spaced-apart locations therealong, said attachment lugs being shaped and arranged to seat in the grooves of the associated rims so that the lugs do not slip relative to the associated sheaves when the sheaves are rotated, a pair of bridles tightly encircling each flotation tread, and pairs of fixing means for fixing the corresponding attachment lugs on said cable pair to the bridle pairs encircling different ones of said flotation treads.

54. The flotation track defined in claim 53 wherein the flotation body of each flotation tread includes a pair of peripheral constrictions spaced apart along its length for receiving the pair of bridles associated with that flotation tread.

55. The flotation track defined in claim 53 wherein the flotation body of each flotation tread is at least partially collapsible so that the flotation tread can be disengaged from the associated pair of bridles.

56. The flotation track defined in claim 52 and further including a pushing rib projecting from the flotation body of each flotation tread in a direction opposite to the direction of the driving rib of that flotation tread.

57. The flotation tread defined in claim 56 wherein the flotation body of each flotation tread is fluid-tight and inflatable/deflatable through a valve mounted in a wall of said flotation body.

58. The flotation track defined in claim 52 wherein the flotation body of each flotation track is generally rectangular with longitudinal corners and spans the pair of cables to which it is connected so that when that tread enters and leaves the water, a corner of the body is presented to the water surface.

59. An aquatic vehicle comprising a body having a front, a rear, a bottom and opposite sides and for containing a pilot;

a seat supported by said body adjacent to the bottom thereof;

a pair of front sheaves rotatably mounted to opposite sides of the body near the front of the body;

a pair of rear sheaves rotatably mounted to opposite sides of the body near the rear of the body, a first flotation track engaged around and extending between the front and rear sheaves on one side of the body;

a second flotation track engaged around and extending between the front and rear sheaves on the other side of the body each said flotation track including an endless band engaged around a front sheave and a rear sheave, a multiplicity of buoyant flotation treads and connecting means for connecting the treads to the band at spaced apart locations therealong to form upper and lower series of flotation treads extending between the associated front and rear sheaves, said connecting means including a bridle engaged around each tread and means for securing each bridle to the associated band;

drive means mounted to said body for producing an output torque, and coupling means for coupling said torque to at least one of the sheaves on each side of said body so as to advance said tracks in order to propel the vehicle.

60. An aquatic vehicle comprising a flotation body having opposite sides;

seating means in the body for supporting a pilot;

an elongated mast having an upper end, a lower end and a longitudinal axis extending between said ends;

mounting means for movably mounting the mast to the body so that the mast has a cone-shape locus of motion around an erect position wherein the mast extends up more or less perpendicular to the body, said mounting means including a socket fixed to said body and a ball mounted to said mast above the lower end thereof, said ball being swivally received in said socket, and fixing means attached to the mast below said ball for selectively fixing the position of the mast within said locus of motion.

61. The vehicle defined in claim 60 wherein the mast is buoyant so that said mast renders the vehicle unstable when inverted and functions as an outrigger to cause the vehicle, when capsized, to float on one of said sides.

62. The vehicle defined in claim 60 and further comprising a sail attached to the mast.

63. The vehicle defined in claim 62 wherein the locus of motion includes a position wherein the mast sets the sail so that when the vehicle is in motion, the wind exerts a force on the sail which tends to lift the vehicle out of the water.

64. An aquatic vehicle comprising a flotation body having opposite sides;

seating means in the body for supporting a pilot;

an elongated mast having an upper end, a lower end and a longitudinal axis extending between said ends;

mounting means for movably mounting the mast to the body so that the mast has a cone-shaped locus of motion around an erect position wherein the mast extends more or less perpendicular to the body;

fixing means for selectively fixing the position of the mast within said locus of motion;

a halyard extending within the mast;

a releasable halyard clutch mounted inside the mast at the top thereof and engaging said halyard, and releasing means connected to the halyard clutch for releasing the clutching action of the halyard clutch so that the halyard can be moved along within the mast.

65. The vehicle defined in claim 64 wherein the halyard clutch comprises a tubular slide mounted within the mast;

a tubular slider slidably positioned within the slide;

a flexible tube having one end connected to said slide and its opposite end connected to said slider, said halyard extending through said slide, slider and flexible tube so that when the halyard moves in a first direction within the mast, the flexible tube functions as a Chinese finger grip to stop such movement, and wherein the said releasing means comprise means for moving the slider toward said one end of the flexible tube so as to relax the flexible tube lengthwise and increase its cross sectional area so that the flexible tube does not grip the halyard.

66. An aquatic vehicle comprising a flotation body;

seating means in the body for supporting a pilot;

an elongated mast having an upper end and a lower end;

mounting means including a gimbal for mounting the mast to the body so that the mast can be swung between an erect position wherein the mast extends up more or less perpendicular to the body and a stowed position wherein the mast is more or less parallel to the body, and fixing means for fixing the mast in said erect position.

67. The vehicle defined in claim 66 wherein the mast is shaped as an air foil so that it functions as a sail.

68. A flotation sheave for an aquatic vehicle comprising a pair of circular rims, each rim having a peripheral groove;

a series of cross bars connected between said rims so that said rims are collinear, said crossbars being spaced an equal distance apart around said rims;

a hub having opposite sides and being situated between said rims, and a multiplicity of spokes connecting the opposite sides of said hub to said rims so that said crossbars are maintained in compression and said spokes are maintained in tension to preserve the circularity of said sheave.

69. The flotation sheave defined in claim 68 and further including a pair of cables engaged around the pair of rims;

a multiplicity of buoyant flotation treads, and connecting means for connecting the treads to the cables at spaced apart locations therealong.

70. The flotation sheave defined in claim 69 wherein each flotation tread comprises a flotation body and a longitudinal driving rib which projects from said body between said pair of cables and is shaped and arranged to engage in a space between the crossbars of said sheave.

71. The flotation sheave defined in claim 68 and further including an axle having one end secured to said hub, said hub and said axle having a common axis, and support means for supporting the axle for rotation about said axis.

72. The sheave defined in claim 71 and further including means for releasably connecting the support means to an aquatic vehicle.

73. An aquatic vehicle comprising a body having a front, a rear, a bottom and opposite sides and for supporting a load;

a pair of moveable flotation tracks mounted to opposite sides of the body, each flotation track including a pair of sheaves, each sheave including a pair of circular rims, a series of crossbars connected between said rims so that said rims are collinear, a hub having opposite sides and being situated between said rims, and a multiplicity of spokes connecting the opposite sides of said hub to said rims so that said crossbars are maintained under compression and said spokes are maintained to tension to preserve the circularity of said rims, an endless band engaged around said sheaves, and a multiplicity of buoyant flotation treads secured to said band at spaced apart locations therealong to form upper and lower series of flotation treads, the lower series of flotation treads of each track extending below the body and having a buoyancy such that they float the vehicle so that the body and the load are supported above the water with the vehicle's center of gravity being close to the bottom of the vehicle, and drive means in said body for selectively moving either or both of said tracks.

* * * * *